US010787017B2

(12) United States Patent
Huang

(10) Patent No.: US 10,787,017 B2
(45) Date of Patent: Sep. 29, 2020

(54) SELF-STANDING PAPER PRODUCT AND METHOD FOR MANUFACTURING SAME

(71) Applicant: IMPRESSION INT'L CORP., New Taipei (TW)

(72) Inventor: Kuo-Ying Huang, New Taipei (TW)

(73) Assignee: IMPRESSION INT'L CORP., New Taipei (TW)

( * ) Notice: Subject to any disclaimer, the term of this patent is extended or adjusted under 35 U.S.C. 154(b) by 13 days.

(21) Appl. No.: 16/053,811

(22) Filed: Aug. 3, 2018

(65) Prior Publication Data

US 2019/0176506 A1 Jun. 13, 2019

(30) Foreign Application Priority Data

Dec. 11, 2017 (TW) ..... 106143335 A

(51) Int. Cl.

| | |
|---|---|
| ***B42D 15/04*** | (2006.01) |
| ***B42D 15/00*** | (2006.01) |
| ***B42D 5/00*** | (2006.01) |
| ***B42D 5/04*** | (2006.01) |
| ***B31D 5/04*** | (2017.01) |
| ***B42D 1/08*** | (2006.01) |
| ***B42D 25/425*** | (2014.01) |

(52) U.S. Cl.

CPC ..... *B42D 15/042* (2013.01); *B31D 5/04* (2013.01); *B42D 5/002* (2013.01); *B42D 5/043* (2013.01); *B42D 15/008* (2013.01); *B42D 1/08* (2013.01); *B42D 25/425* (2014.10); *B42P 2241/12* (2013.01)

(58) Field of Classification Search

None

See application file for complete search history.

(56) References Cited

U.S. PATENT DOCUMENTS 1,464,378 A * 8/1923 Wilburger ..... B65D 85/546 229/72
2,726,803 A * 12/1955 Ketler ..... B65D 5/14 229/5.5
2,988,845 A * 6/1961 MacDougall ..... B42D 15/045 40/445
3,082,932 A * 3/1963 Lutwack ..... B42D 15/045 229/72
3,157,340 A * 11/1964 Gay, Jr. ..... B65D 15/02 229/5.7

(Continued)

*Primary Examiner* — David R Dunn
*Assistant Examiner* — Christopher E Veraa

(57) ABSTRACT

The present invention provides a self-standing paper product and a method for manufacturing the same. The manufacturing method at least includes: a step of forming a primary separating fold line, a step of forming a left vertical separating fold line, a right vertical separating fold line, a left horizontal separating fold line and/or a right horizontal separating fold line, and a step of erection and formation. A primary separating fold line, the left vertical separating fold line, the left horizontal separating fold line, the right vertical separating fold line, and the right horizontal separating fold line are formed on a single paper card for separation into a plurality of front presentation regions and folding regions, and the fold lines are then respectively folded to erect and form the regions, so as to form a self-standing paper product that at least includes a front presentation portion and a folding portion.

6 Claims, 26 Drawing Sheets

(56) References Cited

U.S. PATENT DOCUMENTS

| | | | | | |
|---|---|---|---|---|---|
| 3,451,610 | A * | 6/1969 | Beichler | B65D 5/12 | 229/109 |
| 5,096,073 | A * | 3/1992 | O'Brien | A47F 5/02 | 211/163 |
| 5,606,815 | A * | 3/1997 | Feldwhere | G09F 15/0006 | 40/607.03 |
| 5,678,695 | A * | 10/1997 | Ridgeway | B65D 5/5028 | 206/305 |
| 5,839,762 | A * | 11/1998 | Ho-Chou | B42D 1/08 | 281/38 |
| 6,446,859 | B1 * | 9/2002 | Holladay | B65D 5/10 | 229/109 |
| 8,915,446 | B1 * | 12/2014 | Hammon | G09F 23/06 | 235/487 |
| 2007/0000979 | A1 * | 1/2007 | West | B65D 5/029 | 229/115 |
| 2008/0190996 | A1 * | 8/2008 | Kim | B42F 7/025 | 229/67.1 |

* cited by examiner

SELF-STANDING PAPER PRODUCT AND METHOD FOR MANUFACTURING SAME

CROSS REFERENCE TO RELATED APPLICATIONS

The present application claims the benefit of Taiwanese patent application No. 106143335 filed on Dec. 11, 2017, the contents of which are hereby incorporated by reference.

BACKGROUND OF THE INVENTION

1. Field of the Invention

The present invention relates to card storage products, and in particular, to a self-standing paper product that can accommodate and present an object such as a photo, a picture or a file and a method for manufacturing the same.

2. Description of the Related Art

A conventional photo collection book is an entire book having the form of fixed transparent cases for photos. Obtained photos may be sequentially placed in the transparent cases to achieve the effect of collection and collation. However, it is impossible to separately take one photo for storage or presentation. Another apparatus or structure needs to be used to achieve the objective of separate storage or presentation.

Further, a beautiful scenic is usually presented on a conventional desktop calendar for the enjoyment of viewers. A calendar page of a month is turned over or torn off when the month ends, and the entire desktop calendar is eventually finished and discarded. If a user likes and keeps a photo, it is still difficult to present the photo to the disappointment of the user.

The foregoing problem is a disadvantage in the prior art that the inventor has experienced, and the inventor has paid years of attention to the foregoing problem. Therefore, continuous researches and improvements have given rise to the present invention to replace the prior art.

SUMMARY OF THE INVENTION

To resolve the foregoing problem, the present invention provides a self-standing paper product and a method for manufacturing the same. A folded and erected state is created to place and store an object, so as to form a storage structure of a foldable card.

In other words, the present invention may provide a method for manufacturing a self-standing paper product, where the manufacturing method at least includes: a step of forming a primary separating fold line, where at least more than N primary separating fold lines parallel to an X axis direction are formed on a single paper card, so as to form a front presentation portion separated into a first front presentation region, a second front presentation region, . . . , and an $(N+1)^{th}$ front presentation region, where N is natural number, and N is between 1 and 25; a step of forming a left vertical separating fold line, a right vertical separating fold line, a left horizontal separating fold line and/or a right horizontal separating fold line, where A left vertical separating fold lines and/or B right vertical separating fold lines parallel to a Y axis direction are formed on a left side and/or a right side of at least one presentation region of the front presentation regions of the front presentation portion, and C left horizontal separating fold lines and D right horizontal separating fold lines extending from a left side and/or a right side of each primary separating fold line are formed, so as to form a folding portion separated into a first folding region, a second folding region, . . . , and an $M^{th}$ folding region, where A, B, C, D, and M are all natural numbers, A and B are respectively between 1 and 26, C and D are respectively between 1 and 25, and M is between 1 and 25; and a step of erection and formation, where folding is performed respectively along the primary separating fold lines, the left vertical separating fold lines, the left horizontal separating fold lines, the right vertical separating fold lines, and the right horizontal separating fold lines to erect and form the first front presentation region, the second front presentation region, . . . , and the $(N+1)^{th}$ front presentation region and the first folding region, the second folding region, . . . , and the $M^{th}$ folding region, so as to form a self-standing paper product that at least includes the front presentation portion and the folding portion, where the surface of at least one of the first front presentation region, the second front presentation region, . . . , the $(N+1)^{th}$ front presentation region, the first folding region, the second folding region, . . . , or the $M^{th}$ folding region does not have any graph and text and has a blank, a white background, a black background or an original paper color or is printed with a pattern, a text or the like designated according to a requirement of a user.

According to an embodiment of the present invention, after the step of forming a primary separating fold line, the method further includes a step of forming a joint portion, where a secondary fold line parallel to the primary separating fold lines is formed above the first front presentation region or below the $(N+1)^{th}$ front presentation region, so that the joint portion is obtained through separation on an upper side or a lower side of the paper card.

According to an embodiment of the present invention, the step of erection and formation further includes joining the first front presentation region and the $(N+1)^{th}$ front presentation region by using the joint portion.

According to an embodiment of the present invention, the first front presentation region, the second front presentation region, . . . , and the $(N+1)^{th}$ front presentation region respectively have a first front presentation area, a second front presentation area, . . . , and an $(N+1)^{th}$ front presentation area. The front presentation areas are equal or not equal to each other.

According to an embodiment of the present invention, the first folding region, the second folding region, . . . , and the $M^{th}$ folding region respectively have a first folding area, a second folding area, . . . , and an $M^{th}$ folding area, the folding areas are equal or not equal to each other, and the first folding area, the second folding area, . . . , and the $M^{th}$ folding area are respectively less than the first front presentation area, the second front presentation area, . . . , and the $(N+1)^{th}$ front presentation area.

According to an embodiment of the present invention, the lengths of the left vertical separating fold lines and the lengths of the right vertical separating fold lines are equal or not equal to each other.

In addition, the present invention further provides a self-standing paper product. The self-standing paper product is a paper card, and an unfolded state of the self-standing paper product includes: a front presentation portion and a folding portion. The front presentation portion is located in the front of the paper card. N primary separating fold lines parallel to an X axis direction are disposed in the front presentation portion to sequentially obtain a first front presentation region, a second front presentation region, . . . , and an $(N+1)^{th}$ front presentation region through separation, where N is natural number, and N is between 1 and 25. The folding portion is located on a left side and/or a right side of the front presentation portion, A left vertical separating fold lines and/or B right vertical separating fold lines parallel to a Y axis direction are disposed between the folding portion and the front presentation portion, and C left horizontal separating fold lines and D right horizontal separating fold lines extending from each primary separating fold line towards a left side and a right side are respectively disposed between folding regions, so as to extend outwards from the left side and/or the right side of the front presentation portion to form a first folding region, a second folding region, . . . , and an $M^{th}$ folding region, where A, B, C, D, and M are all natural numbers, A and B are respectively between 1 and 26, C and D are respectively between 1 and 25, and M is between 1 and 52.

According to an embodiment of the present invention, when N=1, a plurality of binder holes are respectively symmetrically opened on upper sides and lower sides of the front presentation portion and the folding portion, and the binder holes arranged in rows in parallel to the primary separating fold lines.

Moreover, according to an embodiment of the present invention, when N≥2, the self-standing paper product is an (N+1)-sided column structure, and further includes at least one placement member having an (N+1)-sided structure; and a plurality of cut lines that are located in a same plane and are not connected to each other are provided in a direction perpendicular to the primary separating fold lines in the first front presentation region, . . . , and the $(N+1)^{th}$ front presentation region of the self-standing paper product, and the (N+1)-sided placement member is inserted in a hollow inside of the self-standing paper product through the cut lines, so that an object is placed through the placement member (S).

The foregoing self-standing paper product structure has many advantages and applications, which are simply listed as follows:

(1) The self-standing paper product structure in the present invention can be used as a photo collection book. In addition, when an object such as a favorite photo, picture or file needs to be separately placed in a photo frame for use, the self-standing paper product structure can further be folded into a simple photo frame having a triangular column form, and can be separately placed on a plane or a desktop for use.

(2) The self-standing paper product structure in the present invention may also be used as a desktop calendar, and if there is a favorite calendar page after use, the calendar page can be separately and completely removed and collected.

(3) The self-standing paper product structure in the present invention may also be used to support a book file and used as a bellyband.

(4) The self-standing paper product structure in the present invention may be used as a postcard. In the presentation portion, not only an object such as a photo, a picture or a file can be placed, but also a text can be written or a painting can be drawn in the presentation portion.

(5) The self-standing paper product structure in the present invention may be used as a menu for restaurant. A dish photo or file may be placed in the presentation portion, and photos are replaced according to seasonal dishes or recommended food.

The objective and achieved effects of the present invention, and the features such as components, shapes, structures, and manufacturing methods of the self-standing paper product structure disclosed in the present invention are described in detail below with reference to the accompanying drawings in the specification of the present invention.

DETAILED DESCRIPTION OF THE PREFERRED EMBODIMENTS

The structure and technical content of a related self-standing paper product in the present invention are described below in detail by using various applicable examples and with reference to the accompanying drawings. However, the present invention is certainly not limited to the used embodiments, drawings or detailed description content.

Moreover, a person skilled in the art should understand that the used embodiments and the accompanying drawings are only used for reference and description but are not used to limit the present invention. Inventions that are completed through modifications or variations that can be easily implemented based on the records are all considered to fall within the scope of the spirit and concept of the present invention. Certainly, the inventions also fall within the claims of the present invention.

Figure 1:
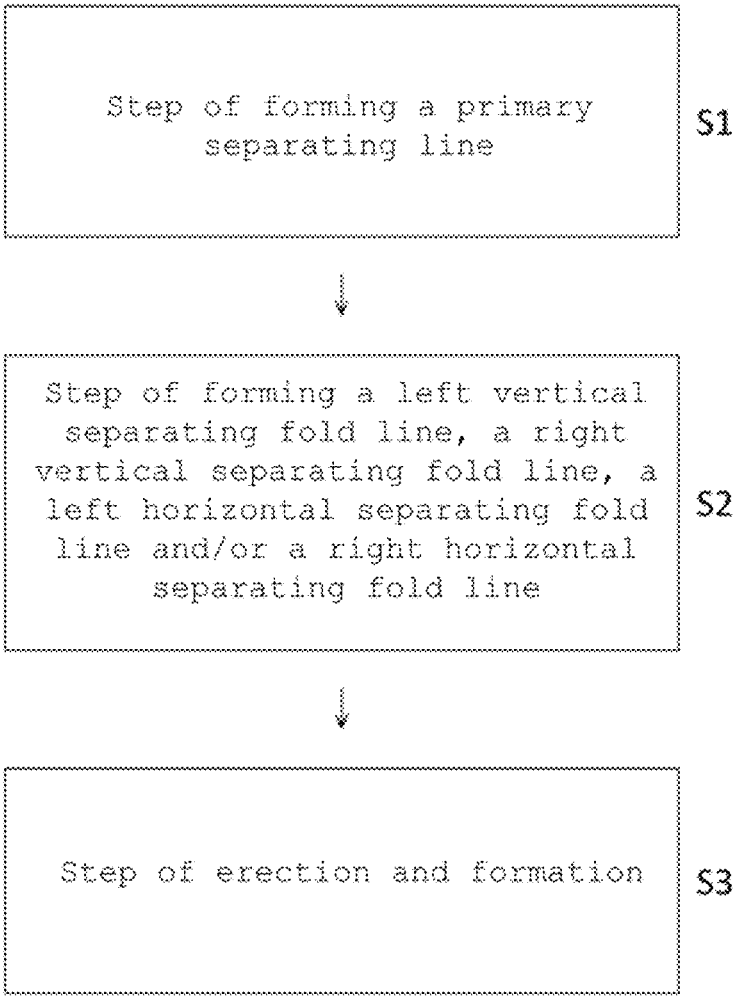
FIG. 1 is a standard schematic flowchart of a method for manufacturing a self-standing paper product according to the present invention.

First, referring to FIG. 1, FIG. 1 is a standard schematic flowchart showing a method for manufacturing a self-standing paper product according to the present invention. The manufacturing method includes the following steps:

A method for manufacturing a self-standing paper product is provided. The manufacturing method at least includes:

a step of forming a primary separating fold line (S1), where at least more than N primary separating fold lines parallel to an X axis direction are formed on a single paper card, so as to form a front presentation portion separated into a first front presentation region, a second front presentation region, . . . , and an $(N+1)^{th}$ front presentation region, where N is natural number, and N is between 1 and 25;

a step of forming a left vertical separating fold line, a right vertical separating fold line, a left horizontal separating fold line and/or a right horizontal separating fold line (S2), where A left vertical separating fold lines and/or B right vertical separating fold lines parallel to a Y axis direction are formed on a left side and/or a right side of the single paper card, and C left horizontal separating fold lines and/or D right horizontal separating fold lines correspondingly extending from a left side and/or a right side of each primary separating fold line are formed, so as to form a folding portion separated into a first folding region, a second folding region, . . . , and an $M^{th}$ folding region, where A, B, C, D, and M are all natural numbers, A and B are respectively between 1 and 26, C and D are respectively between 1 and 25, and M is between 1 and 25; and a step of erection and formation (S3), where folding is performed respectively along the primary separating fold lines, the left vertical separating fold lines, the right vertical separating fold lines, the left horizontal separating fold lines, and the right horizontal separating fold lines to erect and form the first front presentation region, the second front presentation region, . . . , and the $(N+1)^{th}$ front presentation region, the first folding region, the second folding region, . . . , and the $M^{th}$ folding region, so as to form a self-standing paper product structure that at least includes the front presentation portion and the folding portion, where the surface of at least one of the first front presentation region, the second front presentation region, . . . , the $(N+1)^{th}$ front presentation region, the first folding region, the second folding region, . . . , or the $M^{th}$ folding region does not have any graph and text and has a blank, a white background, a black background or an original paper color or is printed with a pattern, a text or the like designated according to a requirement of a user.

A self-standing paper product manufactured by using the foregoing method for manufacturing a self-standing paper product in the present invention is a self-standing paper product for presentation that can stand by itself and at the same time have at least more than two functions of advertisement and promotion, presentation and description, and storage for commodities.

The technical measure used in the present invention to achieve an expected inventive objective is further described below with reference to the drawings and the preferred embodiments of the present invention.

Embodiment 1

Figure 2:
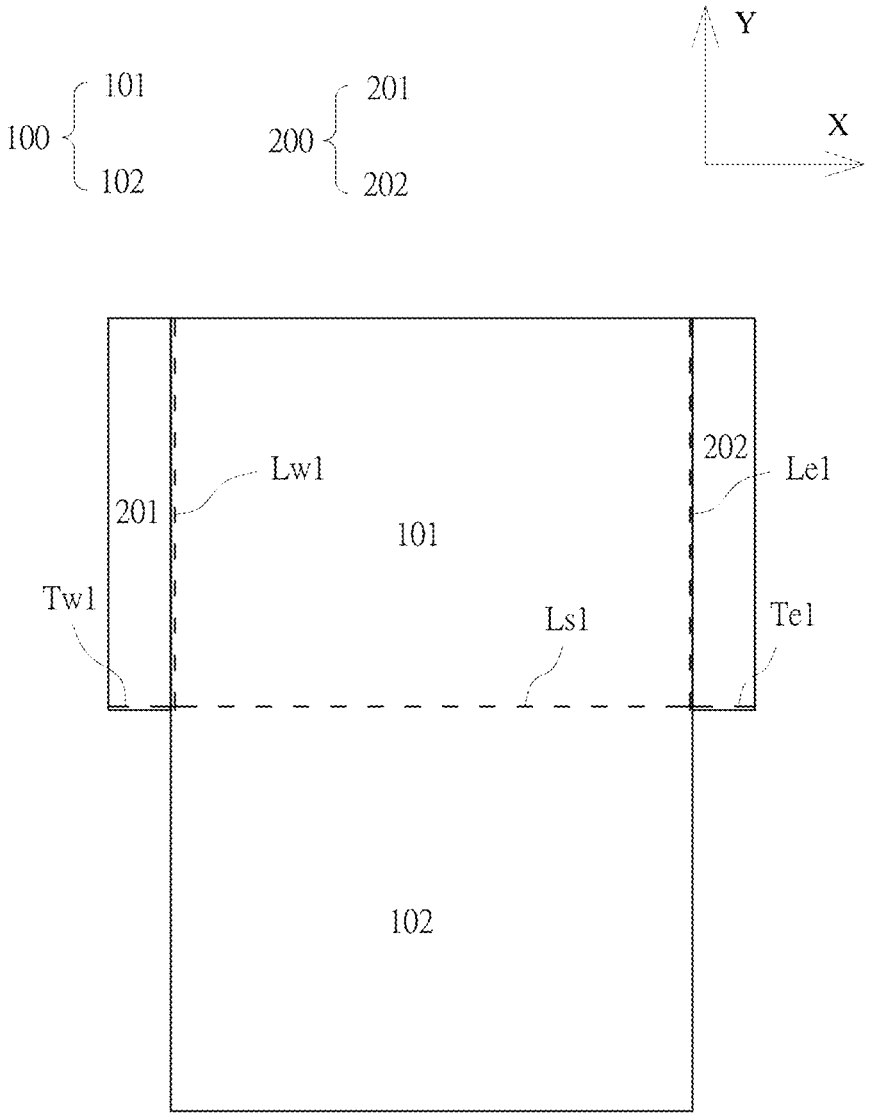
FIG. 2 is a schematic diagram of an unfolded state of Embodiment 1 of a self-standing paper product according to the present invention.

Referring to FIG. 2, FIG. 2 is a schematic diagram showing an unfolded state of Embodiment 1 of a self-standing paper product according to the present invention. In this embodiment, N=1, and M=2. The self-standing paper product is a paper card, and an unfolded state of the self-standing paper product includes: a front presentation portion (100) and a folding portion (200). The front presentation portion is separated by one primary separating fold line (Ls1) into a first front presentation region (101) and a second front presentation region (102). In the first front presentation region (101), one left vertical separating fold line (Lw1) and one left horizontal separating fold line (Tw1) extend to form a first folding region (201), one right vertical separating fold line (Le1) and one right horizontal separating fold line (Te1) extend to form a second folding region (202), the left vertical separating fold line (Lw1) and the right vertical separating fold line (Le1) respectively have equal lengths to a left lateral side and a right lateral side of the first front presentation region (101), and the length of the left horizontal separating fold line (Tw1) and the length of the right horizontal separating fold line (Te1) may be equal or not equal to each other.

Next, folding is performed respectively along the primary separating fold line (Ls1), the left vertical separating fold line (Lw1), the left horizontal separating fold line (Tw1), the right vertical separating fold line (Le1), and the right horizontal separating fold line (Te1), to erect and form the first front presentation region (101), the second front presentation region (102), the first folding region (201), and the second folding region (202), so that an inverted-V-shaped self-standing paper product that can stand by itself can be formed.

In this embodiment, the first front presentation region (101) has a first front presentation area, the second front presentation region (102) has a second front presentation area, and the first front presentation area is equal to the second front presentation area.

In addition, according to the technical concept of the present invention, the folding portion (200) is connected to the first front presentation region (101), but the present invention is not limited thereto. For example, the first folding region (201) and the second folding region (202) may both be located on a left side or a right side of the front presentation portion (100) or the first folding region (201) and the second folding region (202) are respectively connected to the second front presentation region (102), which may be designed according to a requirement of a user.

Embodiment 2

Figure 3:
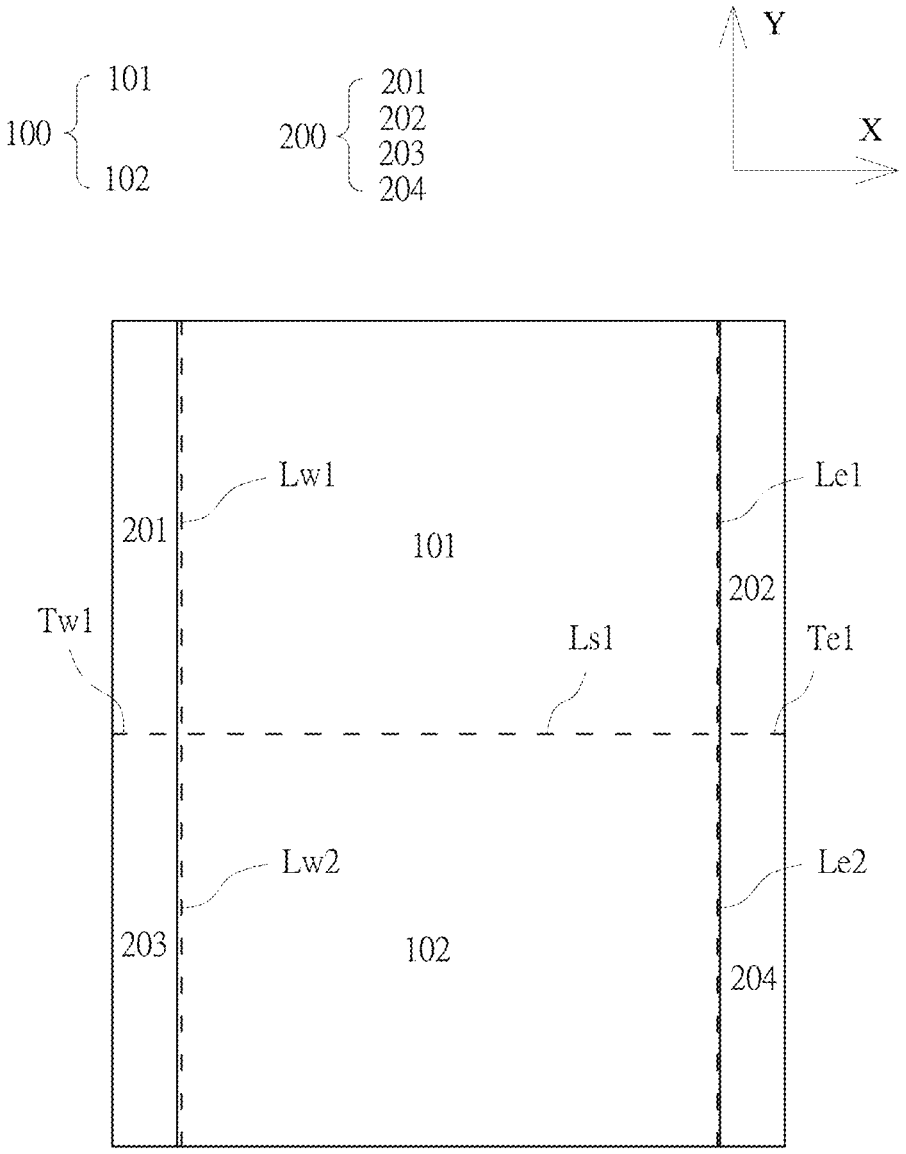
FIG. 3 is a schematic diagram of an unfolded state of Embodiment 2 of a self-standing paper product according to the present invention.

Referring to FIG. 3, FIG. 3 is a schematic diagram showing an unfolded state of Embodiment 2 of a self-standing paper product according to the present invention. In this embodiment, N=1, and M=4. The self-standing paper product is a paper card, and an unfolded state of the self-standing paper product includes: a front presentation portion (100) and a folding portion (200). Same as that in Embodiment 1, the front presentation portion is separated by one primary separating fold line (Ls1) into a first front presentation region (101) and a second front presentation region (102). On left sides of the first front presentation region (101) and the second front presentation region (102), two left vertical separating fold lines (Lw1, Lw2) and one left horizontal separating fold line (Tw1) extend to form a first folding region (201) and a third folding region (203). On right sides of the first front presentation region (101) and the second front presentation region (102), two right vertical separating fold lines (Le1, Le2) and one right horizontal separating fold line (Te1) extend to form a second folding region (202) and a fourth folding region (204). The left vertical separating fold lines (Lw1, Lw2) and the right vertical separating fold lines (Le1, Le2) respectively have equal lengths to left lateral sides and right lateral sides of the connected front presentation regions. The length of the left horizontal separating fold line (Tw1) and the length of the right horizontal separating fold line (Te1) may be equal or not equal to each other.

Next, folding is performed respectively along the primary separating fold line (Ls1), the left vertical separating fold lines (Lw1, Lw2), the left horizontal separating fold line (Tw1), the right vertical separating fold lines (Le1, Le2), and the right horizontal separating fold line (Te1), to erect and form the first front presentation region (101), the second front presentation region (102), the first folding region (201), . . . , and the fourth folding region (204), so that an inverted-V-shaped self-standing paper product that can stand by itself can be formed.

Figure 4A:
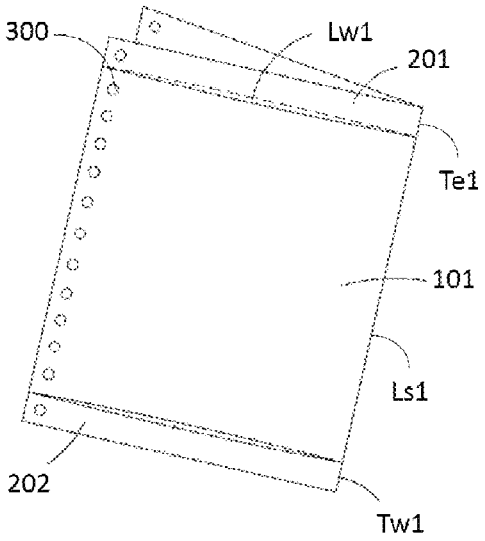
FIG. 4A to FIG. 4C are respectively schematic diagrams of a folded and erected state of Embodiment 2 of a self-standing paper product according to the present invention.
Figure 4B:
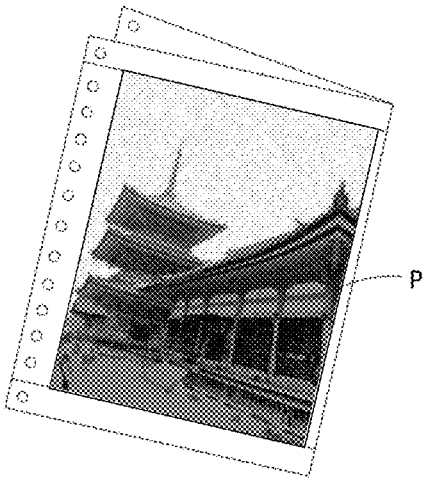
Figure 4C:
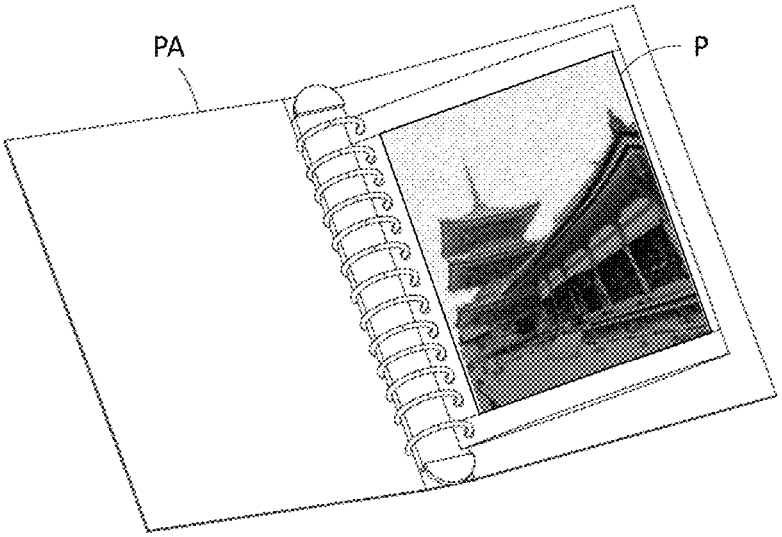

In addition, referring to FIG. 4A to FIG. 4C, in an embodiment of a self-standing paper product shown in FIG. 4A to FIG. 4C, a plurality of binder holes (300) are respectively symmetrically opened on upper sides and lower sides of the front presentation portion (100) and the folding portion (200) of the self-standing paper product. The binder holes (300) are arranged in parallel to a primary separating fold line (Ls1) and in rows. After an object such as a photo (P), a picture or a file is inserted in the folding portion, the self-standing paper product may be placed in a loose leaf binder (PA) through the binder holes (300), so as to achieve the effect of presentation or proper storage.

Embodiment 3

Figure 5:
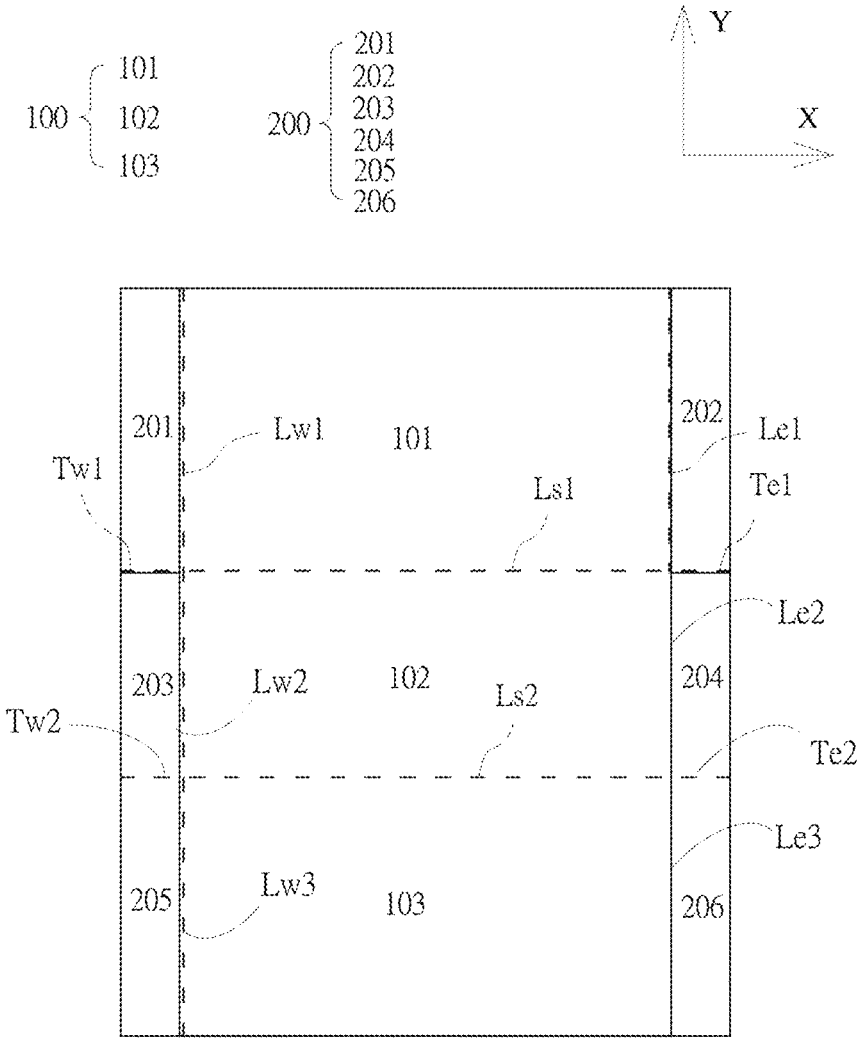
FIG. 5 is a schematic diagram of an unfolded state of Embodiment 3 of a self-standing paper product according to the present invention.
Figure 6:
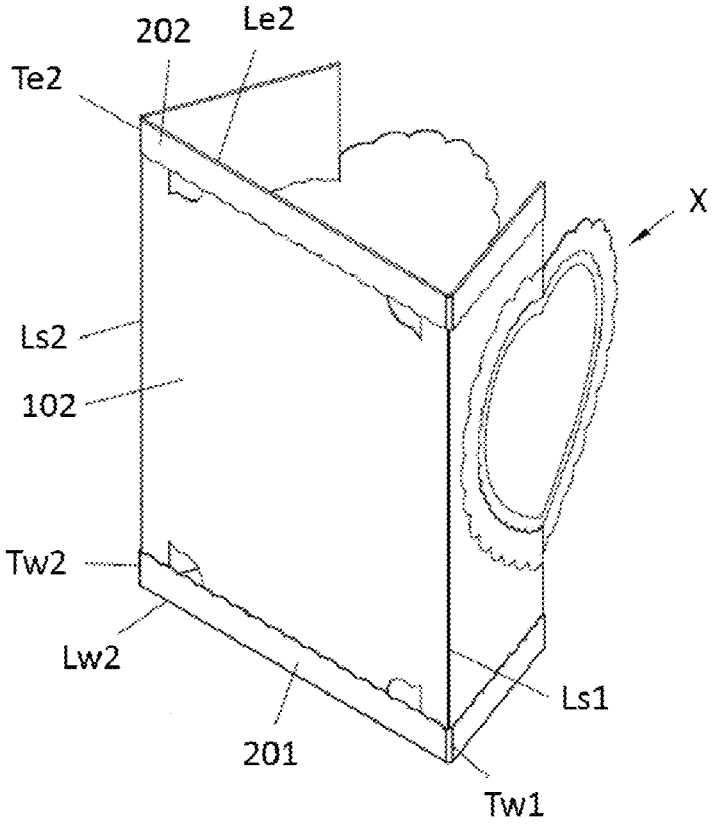
FIG. 6 is a schematic diagram of a folded and erected state of Embodiment 3 of a self-standing paper product according to the present invention.

Referring to FIG. 5 and FIG. 6, FIG. 5 and FIG. 6 are respectively schematic diagrams showing an unfolded state and an erected state of Embodiment 3 of a self-standing paper product according to the present invention. In this embodiment, N=2, and M=6. The self-standing paper product is a paper card, and an unfolded state of the self-standing paper product includes: a front presentation portion (100) and a folding portion (200). The front presentation portion is separated by two primary separating fold lines (Ls1, Ls2) into a first front presentation region (101), a second front presentation region (102), and a third front presentation region (103). On left sides of the first front presentation region (101), the second front presentation region (102), and the third front presentation region (103), three left vertical separating fold lines (Lw1, Lw2, Lw3) and two left horizontal separating fold lines (Tw1, Tw2) extend to forma first folding region (201), a third folding region (203), and a fifth folding region (205). On right sides of the first front presentation region (101), the second front presentation region (102), and the third front presentation region (103), three right vertical separating fold lines (Le1, Le2, Le3) and two right horizontal separating fold lines (Te1, Te2) extend to form a second folding region (202), a fourth folding region (204), and a sixth folding region (206). The left vertical separating fold lines (Lw1, Lw2, Lw3) and the right vertical separating fold lines (Le1, Le2, Le3) respectively have equal lengths to left lateral sides and right lateral sides of the connected front presentation regions. The lengths of the left horizontal separating fold lines (Tw1, Tw2) and the lengths of the right horizontal separating fold lines (Te1, Te2) may be equal or not equal to each other.

Next, folding is performed respectively along the primary separating fold lines (Ls1, Ls2), the left vertical separating fold lines (Lw1, Lw2, Lw3), left horizontal separating fold lines (Tw1, Tw2), the right vertical separating fold lines (Le1, Le2, Le3), and the right horizontal separating fold lines (Te1, Te2), to erect and form the first front presentation region (101), the second front presentation region (102), the third front presentation region (103), the first folding region (201), . . . , and the sixth folding region (206), so that a square-C-shaped self-standing paper product that can stand by itself can be formed. As shown in FIG. 6, the self-standing paper product may be designed as a card X, and a pattern form is designed in the front presentation regions (101, 102, 103) or an object such as a photo, a picture or a file is inserted in the folding regions (201, . . . , 206).

Embodiment 4

Referring to FIG. 7 to FIG. 11, FIG. 7 to FIG. 11 are respectively schematic diagrams showing an unfolded state and an erected state of Embodiment 4 of a self-standing paper product according to the present invention, where N=2 and M=2, 4 or 6. The self-standing paper product is a paper card, and an unfolded state of the self-standing paper product includes: a front presentation portion (100) and a folding portion (200). Same as Embodiment 3, the front presentation portion is separated by two primary separating fold lines (Ls1, Ls2) into a first front presentation region (101), a second front presentation region (102), and a third front presentation region (103). At least two of the first front presentation area, the second front presentation area, and the third front presentation area are equal.

In addition, a joint portion (110) extends on a lower side of the third front presentation region (103), and one secondary fold line (L3) is disposed between the joint portion (110) and the third front presentation region (103). The length of the secondary fold line is less than or equal to that of the primary separating fold line. During the step of erection and formation, the joint portion (110) and the first front presentation region (101) may be joined. For example, the joint portion (110) is bonded to a rear surface of the first front presentation region (101).

According to the technical concept of the present invention, a fastening portion and a fastened portion (not shown) may be respectively disposed on an upper side of the first front presentation region (101) and a lower side of the third front presentation region (103), so that during the step of erection and formation, two sides of the paper card may be fastened together by using the fastening portion and the fastened portion.

Figure 7:
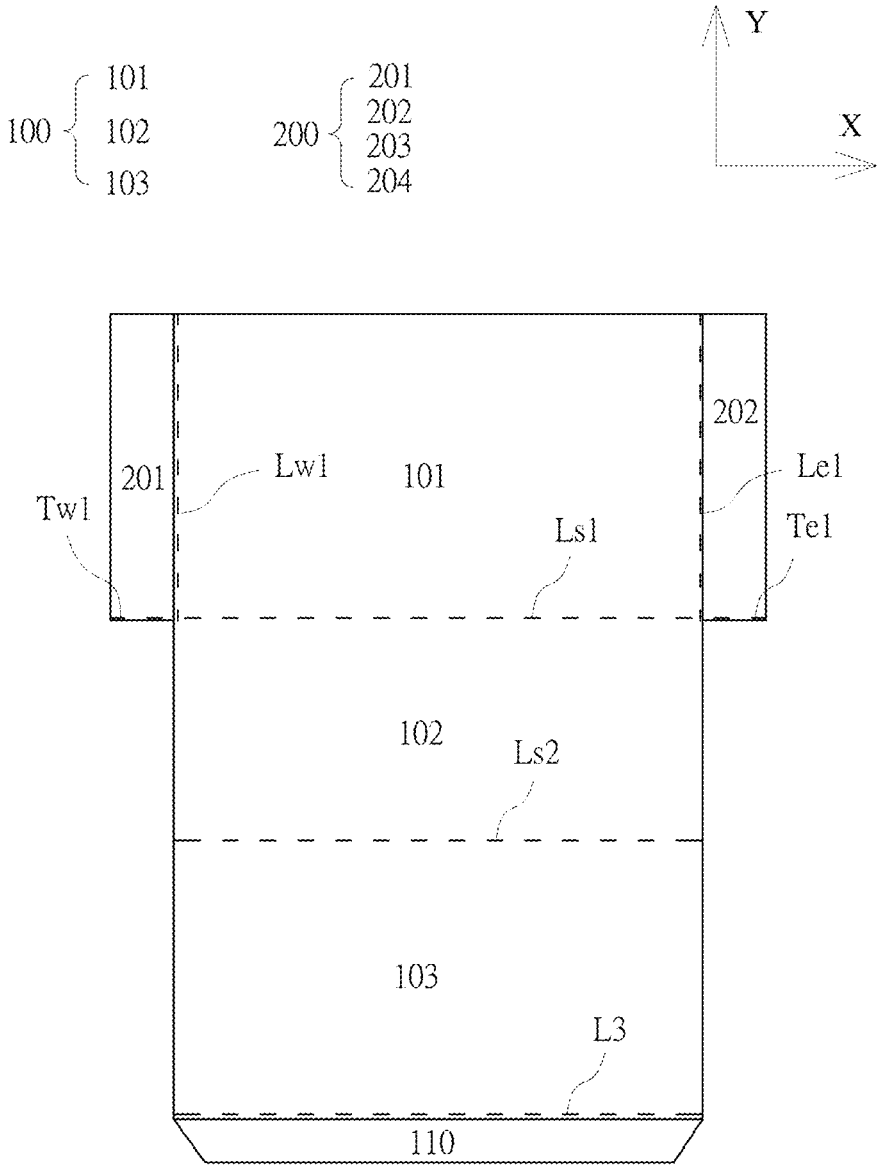
FIG. 7 is a schematic diagram of an unfolded state of Embodiment 4 of a self-standing paper product according to the present invention.

As shown in FIG. 7, when M=2, on a left side of the first front presentation region (101), one left vertical separating fold line (Lw1) and one left horizontal separating fold line (Tw1) extend to forma first folding region (201), and on a right side of the first front presentation region (101), one right vertical separating fold line (Le1) and one right horizontal separating fold line (Te1) extend to forma second folding region (202). The left vertical separating fold line (Lw1) and the right vertical separating fold line (Le1) respectively have equal lengths to a left lateral side and a right lateral side of the connected first front presentation region (101). The length of the left horizontal separating fold line (Tw1) and the length of the right horizontal separating fold line (Te1) may be equal or not equal to each other.

Next, folding is performed respectively along the primary separating fold lines (Ls1, Ls2), the left vertical separating fold line (Lw1), the left horizontal separating fold line (Tw1), the right vertical separating fold line (Le1), the right horizontal separating fold line (Te1), and the secondary fold line (L3), to erect and form the first front presentation region (101), the second front presentation region (102), the third front presentation region (103), the first folding region (201), the second folding region (202), and the joint portion (110), so that a self-standing paper product in a triangular column form that can stand by itself can be formed.

In this embodiment, the folding portion (200) is connected to the first front presentation region (101), but the present invention is not limited thereto. For example, the first folding region (201) and the second folding region (202) may alternatively be respectively connected to the second front presentation region (102) or the third front presentation region (103).

Figure 8:
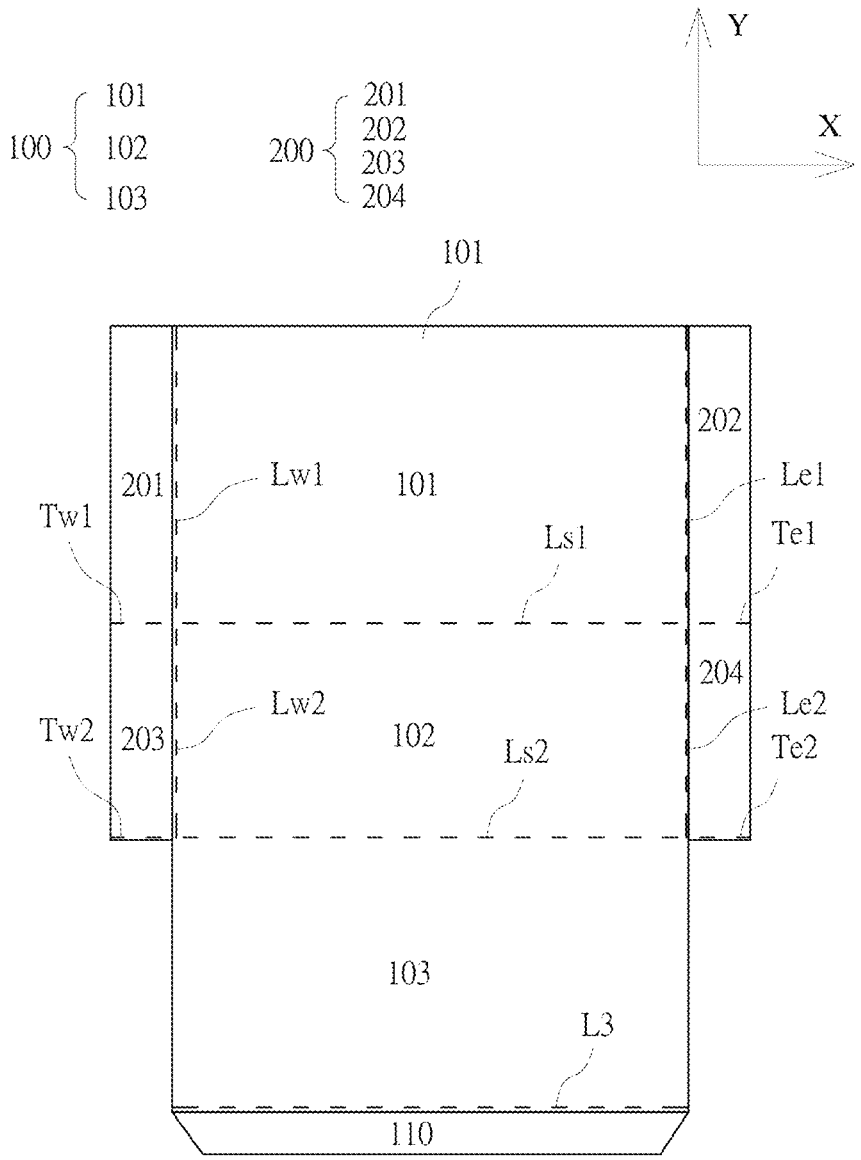
FIG. 8 is a schematic diagram of another unfolded state of Embodiment 4 according to the present invention.

Then, as shown in FIG. 8, when M=4, on left sides of the first front presentation region (101) and the second front presentation region (102), two left vertical separating fold lines (Lw1, Lw2) and two left horizontal separating fold lines (Tw1, Tw2) extend to form the first folding region (201) and the third folding region (203). On right sides of the first front presentation region (101) and the second front presentation region (102), two right vertical separating fold lines (Le1, Le2) and two right horizontal separating fold lines (Te1, Te2) extend to form the second folding region (202) and the fourth folding region (204). The left vertical separating fold lines (Lw1, Lw2) and the right vertical separating fold lines (Le1, Le2) respectively have equal lengths to left lateral sides and right lateral sides of the connected front presentation regions. The lengths of the left horizontal separating fold lines (Tw1, Tw2) and the lengths of the right horizontal separating fold lines (Te1, Te2) may be equal or not equal to each other.

Figure 9A:
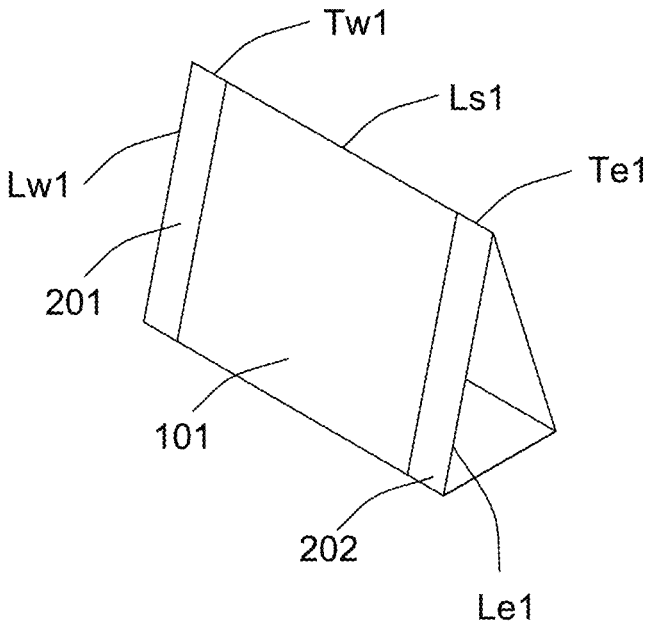
FIG. 9A is a schematic diagram of an erected state in FIG. 8 according to the present invention.
Figure 9B:
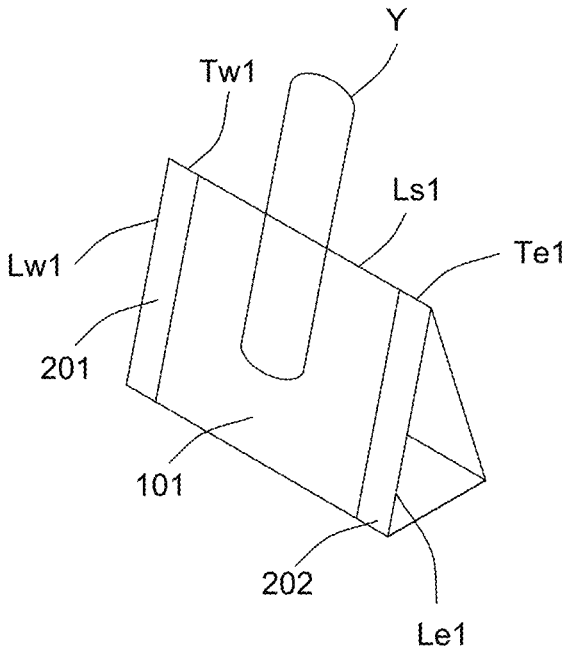
FIG. 9B is a schematic diagram of a folded and erected state of another application in FIG. 8 according to the present invention.

Next, folding is performed respectively along the primary separating fold lines (Ls1, Ls2), the left vertical separating fold lines (Lw1, Lw2), the left horizontal separating fold lines (Tw1, Tw2), the right vertical separating fold lines (Le1, Le2), the right horizontal separating fold lines (Te1, Te2), and the secondary fold line (L3), to erect and form the first front presentation region (101), the second front presentation region (102), the third front presentation region (103), the first folding region (201), . . . , the fourth folding region (204), and the joint portion (110), so that a self-standing paper product in a triangular column form that can stand by itself can be formed. As shown in FIG. 9A, a user may design a pattern form in the first front presentation region (101) or the second front presentation region (102) or insert an object such as a photo, a picture or a file in the folding portion, and horizontally place the third front presentation region (103) on a desktop, to produce an effect of stabilizing a self-standing paper product. In addition, a supporting member Y that is cut from the front presentation regions and is folded outwardly is provided in the first front presentation region (101) of the self-standing paper product shown in FIG. 9B. When an object such as a photo, a picture or a file inserted in the folding portion is relatively high, the supporting member Y may provide an additional support effect.

Figure 10:
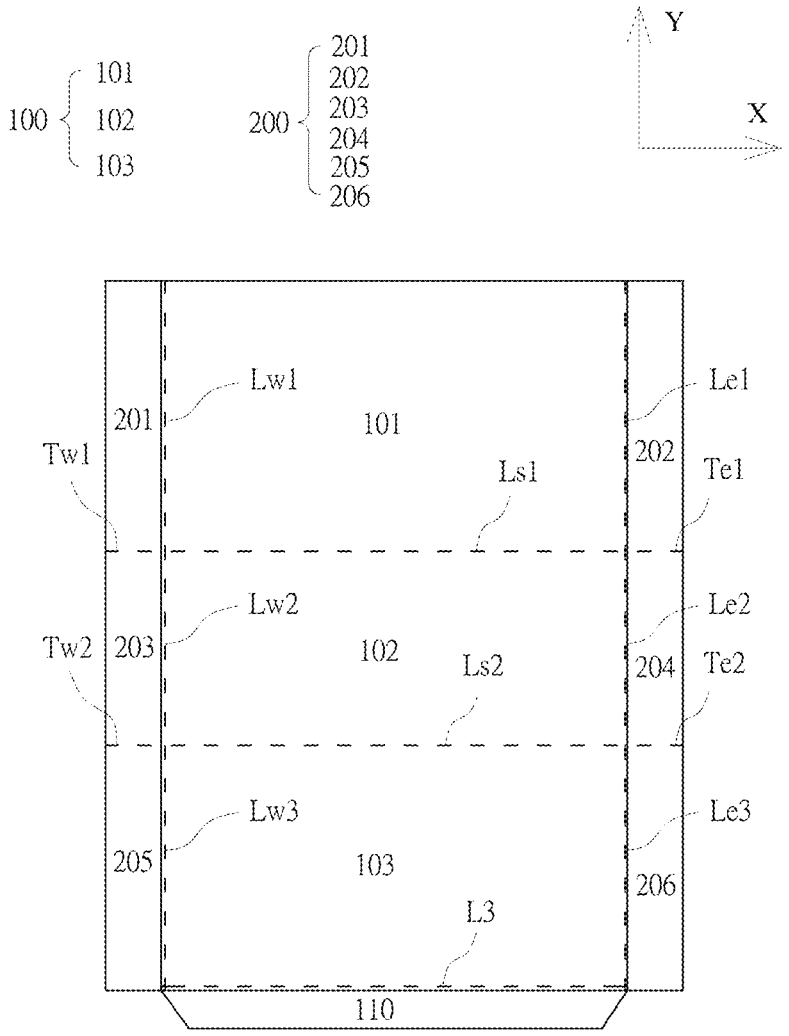
FIG. 10 is a schematic diagram of still another unfolded state of Embodiment 4 according to the present invention.

Further, referring to FIG. 10, when M=6, on left sides of the first front presentation region (101), the second front presentation region (102), and the third front presentation region (103), three left vertical separating fold lines (Lw1, Lw2, Lw3) and two left horizontal separating fold lines (Tw1, Tw2) extend to form the first folding region (201), the third folding region (203), and the fifth folding region (205). On right sides of the first front presentation region (101), the second front presentation region (102), and the third front presentation region (103), three right vertical separating fold lines (Le1, Le2, Le3) and two right horizontal separating fold lines (Te1, Te2) extend to form the second folding region (202), the fourth folding region (204), and the sixth folding region (206). The left vertical separating fold lines (Lw1, Lw2, Lw3) and the right vertical separating fold lines (Le1, Le2, Le3) respectively have equal lengths to left lateral sides and right lateral sides of the connected front presentation regions. The lengths of the left horizontal separating fold lines (Tw1, Tw2) and the lengths of the right horizontal separating fold lines (Te1, Te2) may be equal or not equal to each other.

Figure 11:
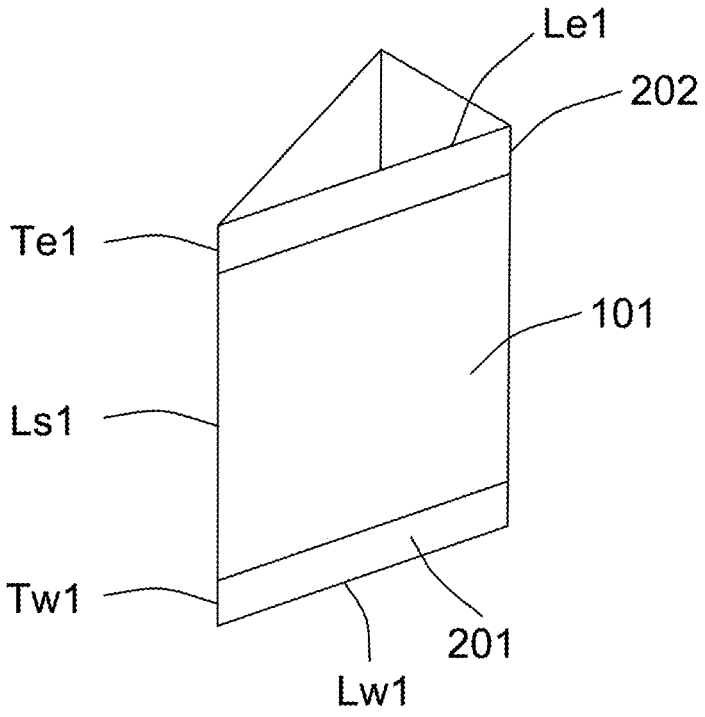
FIG. 11 is a schematic diagram of a folded and erected state in FIG. 10 according to the present invention.
Figure 12:
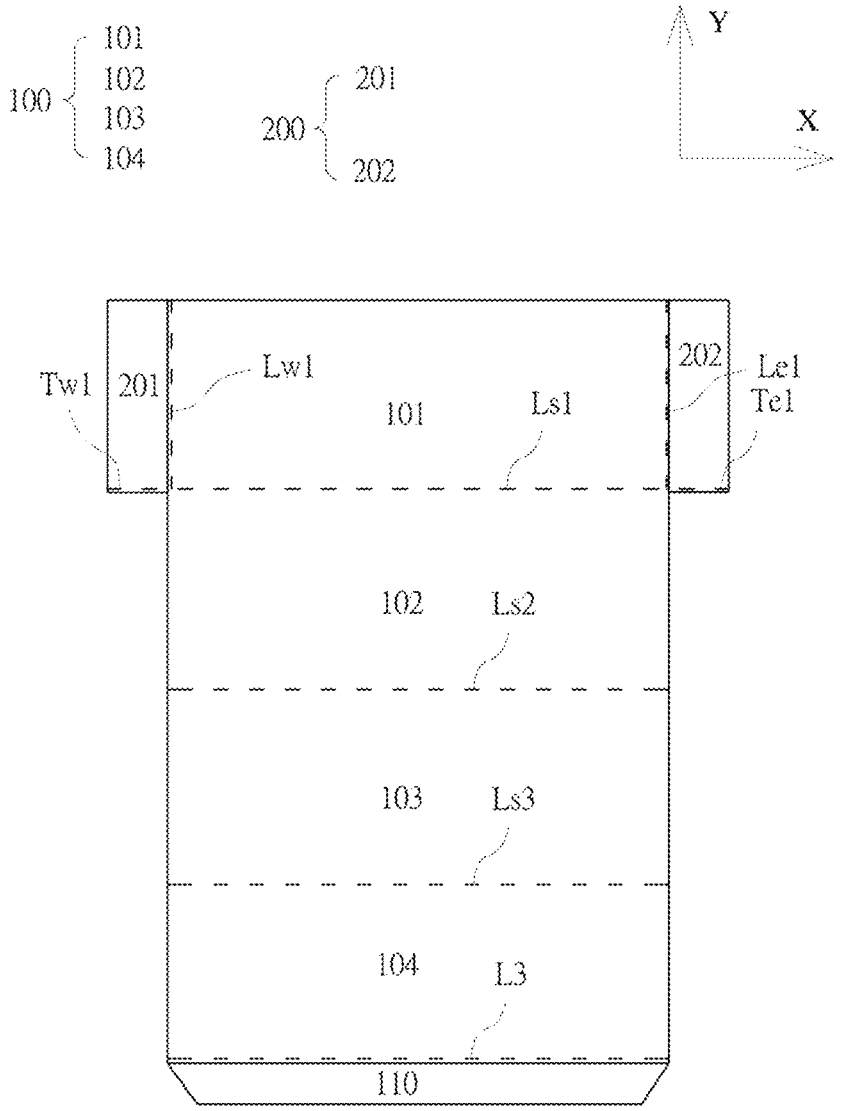
FIG. 12 to FIG. 15 are respectively schematic diagrams of different unfolded states of Embodiment 5 according to the present invention.
Figure 13:
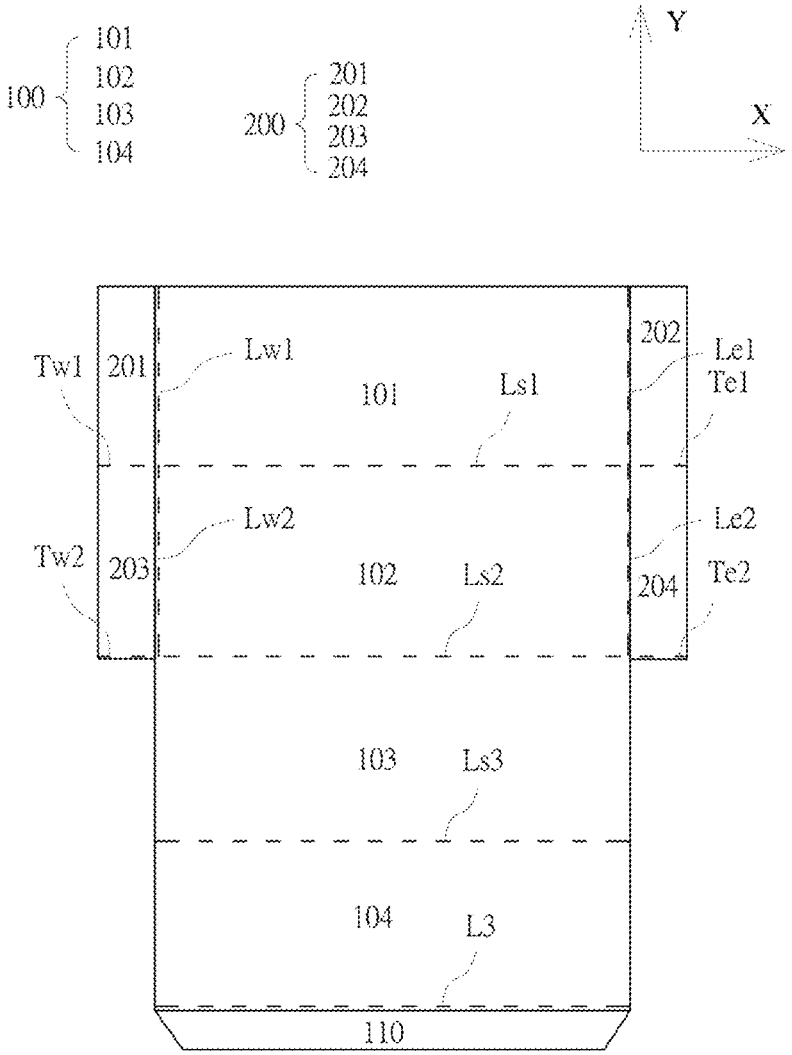
Figure 14:
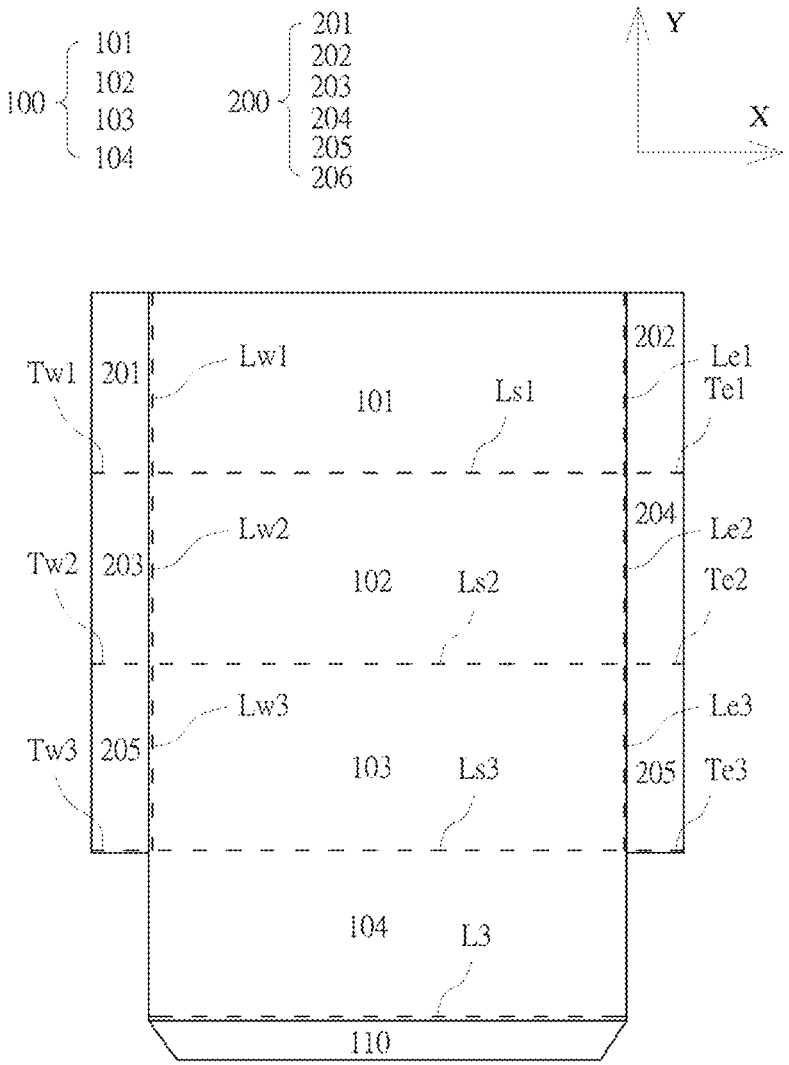

Next, folding is performed respectively along the primary separating fold lines (Ls1, Ls2), the left vertical separating fold lines (Lw1, Lw2, Lw3), left horizontal separating fold lines (Tw1, Tw2), the right vertical separating fold lines (Le1, Le2, Le3), the right horizontal separating fold lines (Te1, Te2), and the secondary fold line (L3), to erect and form the first front presentation region (101), the second front presentation region (102), the third front presentation region (103), the first folding region (201), . . . , the sixth folding region (206), and the joint portion (110), so that a self-standing paper product in a triangular column form that can stand by itself can be formed. As shown in FIG. 11, pattern forms may be designed in the three front presentation regions of the self-standing paper product according to a requirement of a user or an object such as a photo, a picture or a file may be inserted in the folding portion.

Embodiment 5

Referring to FIG. 12 to FIG. 16, FIG. 12 to FIG. 16 are respectively schematic diagrams showing an unfolded state and an erected state of Embodiment 5 of a self-standing paper product according to the present invention. N=3, and M=2, 4, 6 or 8. The self-standing paper product is a paper card, and an unfolded state of the self-standing paper product includes: a front presentation portion (100) and a folding portion (200). The front presentation portion is separated by three primary separating fold lines (Ls1, Ls2, Ls3) into a first front presentation region (101), . . . , and a fourth front presentation region (104). In addition, a joint portion (110) extends on a lower side of the fourth front presentation region (104), and one secondary fold line (L3) is disposed between the joint portion (110) and the fourth front presentation region (104). The length of the secondary fold line (L3) is less than or equal to those of the primary separating fold lines (Ls1, Ls2, and Ls3). During the step of erection and formation, the joint portion (110) and the first front presentation region (101) may be joined. For example, the joint portion (110) is bonded to a rear surface of the first front presentation region (101).

According to the technical concept of the present invention, a fastening portion and a fastened portion (not shown) may be respectively disposed on an upper side of the first front presentation region (101) and a lower side of the fourth front presentation region (104), so that during the step of erection and formation, two sides of the paper card may be fastened together by using the fastening portion and the fastened portion.

FIG. 12 to FIG. 15 are respectively schematic diagrams showing an unfolded state when a quantity M of folding regions of the self-standing paper product in the present invention is 2, 4, 6 or 8. As the required quantity of the folding regions increases, corresponding quantities of left vertical separating fold lines (Lw1, . . . , Lw4), left horizontal separating fold lines (Tw1, . . . , Tw3), right vertical separating fold lines (Le1, . . . , Le4), and right horizontal separating fold lines (Te1, . . . , Te3) are disposed.

Figure 15:
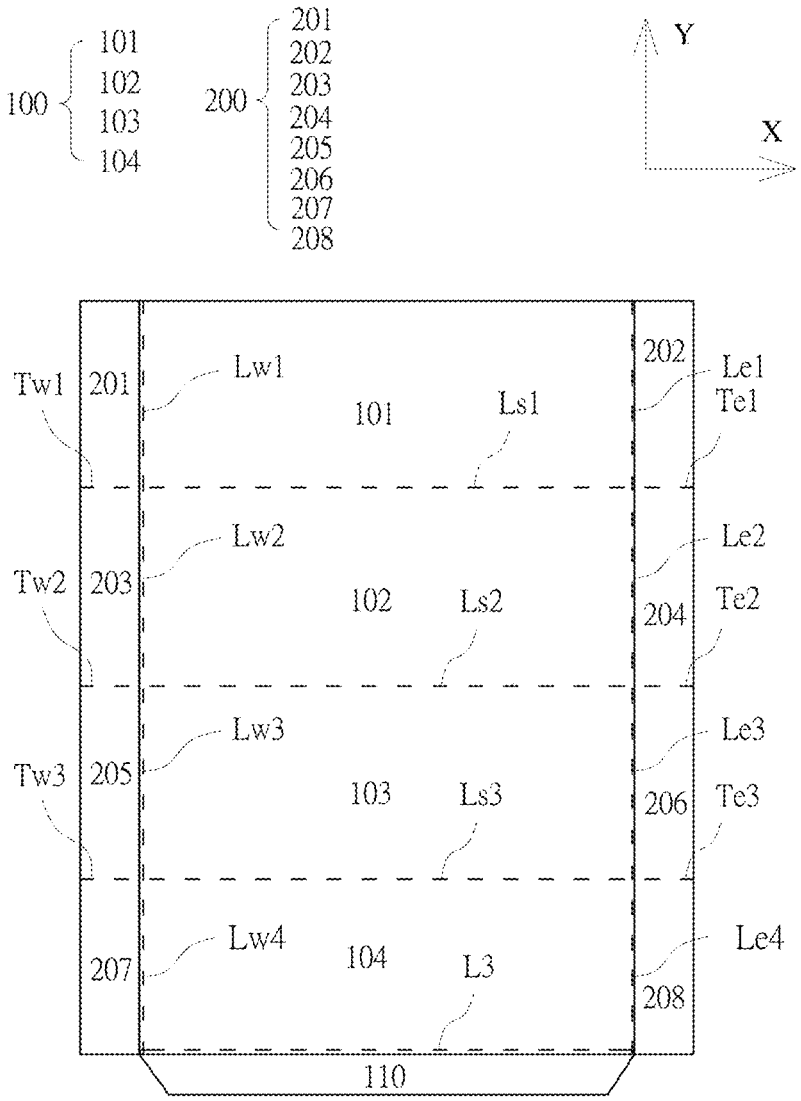

For example, referring to FIG. 15, when M=8, in a folding portion (200), on left sides of a first front presentation region (101), . . . , and a fourth front presentation region (104), four left vertical separating fold lines (Lw1, . . . , Lw4) and three left horizontal separating fold lines (Tw1, . . . , Tw3) extend to form a first folding region (201), a third folding region (203), . . . , and a seventh folding region (207). On right sides of the first front presentation region (101), . . . , and the fourth front presentation region (104), four right vertical separating fold lines (Le1, . . . , Le4) and three right horizontal separating fold lines (Te1, . . . , Te3) extend to forma second folding region (202), a fourth folding region (204), . . . , and an eighth folding region (208). The left vertical separating fold lines (Lw1, . . . , Lw4) and the right vertical separating fold lines (Le1, Le4) respectively have equal lengths to a left lateral side and a right lateral side of a connected front presentation portion. The lengths of the left horizontal separating fold lines (Tw1, . . . , Tw3) and the lengths of the right horizontal separating fold lines (Te1, . . . , Te3) may be equal or not equal to each other.

Figure 16:
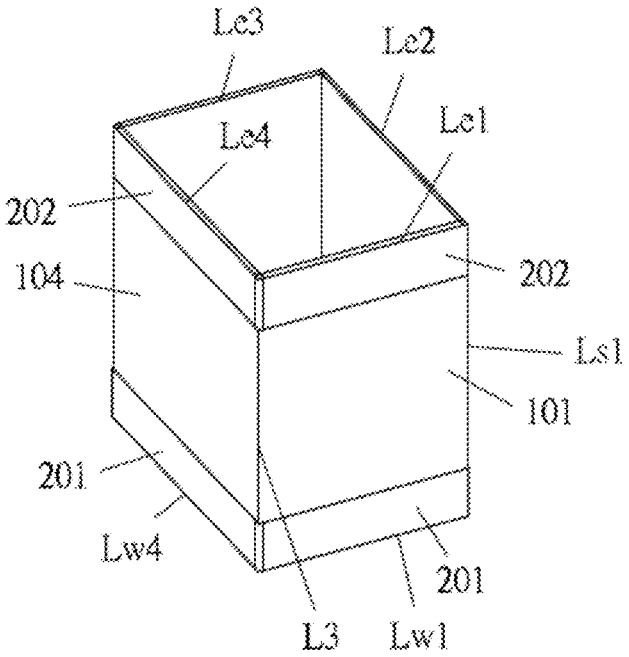
FIG. 16 is a schematic diagram of a folded and erected state in FIG. 15 according to the present invention.
Figure 17:
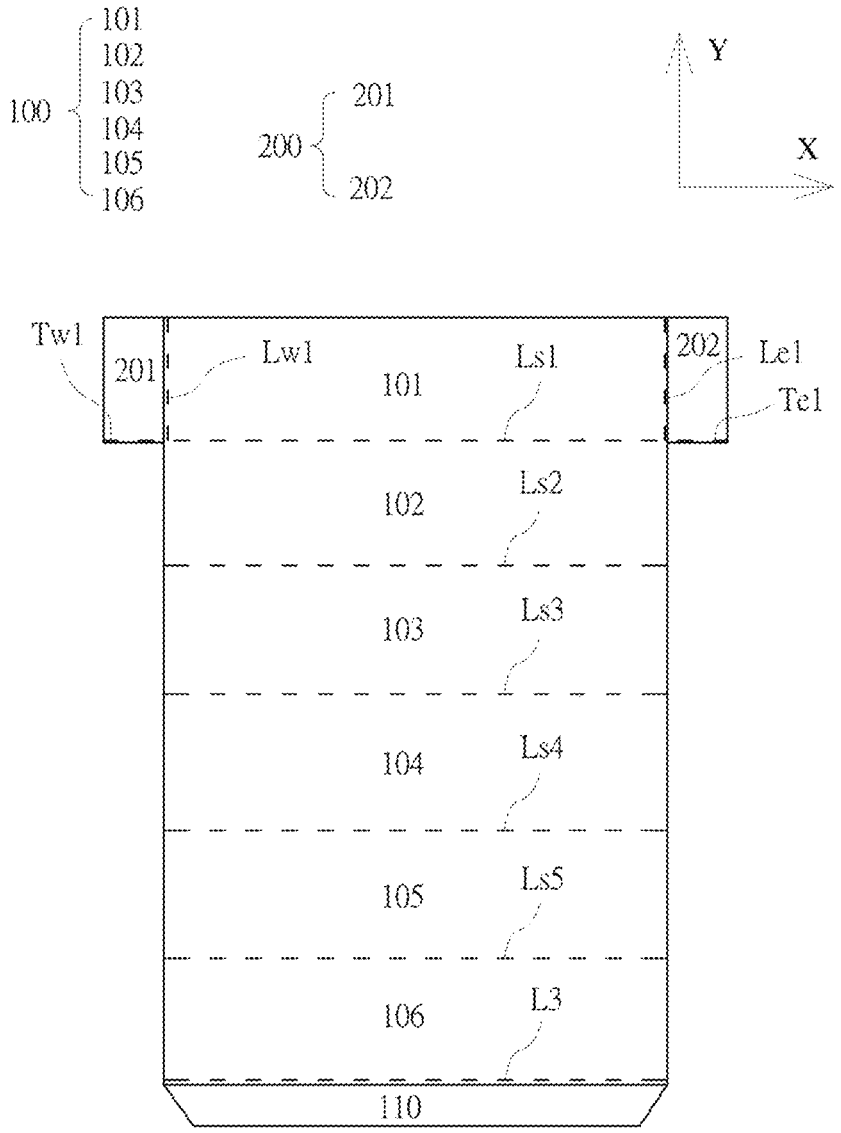
FIG. 17 to FIG. 22 are respectively schematic diagrams of different unfolded states of Embodiment 6 according to the present invention.
Figure 18:
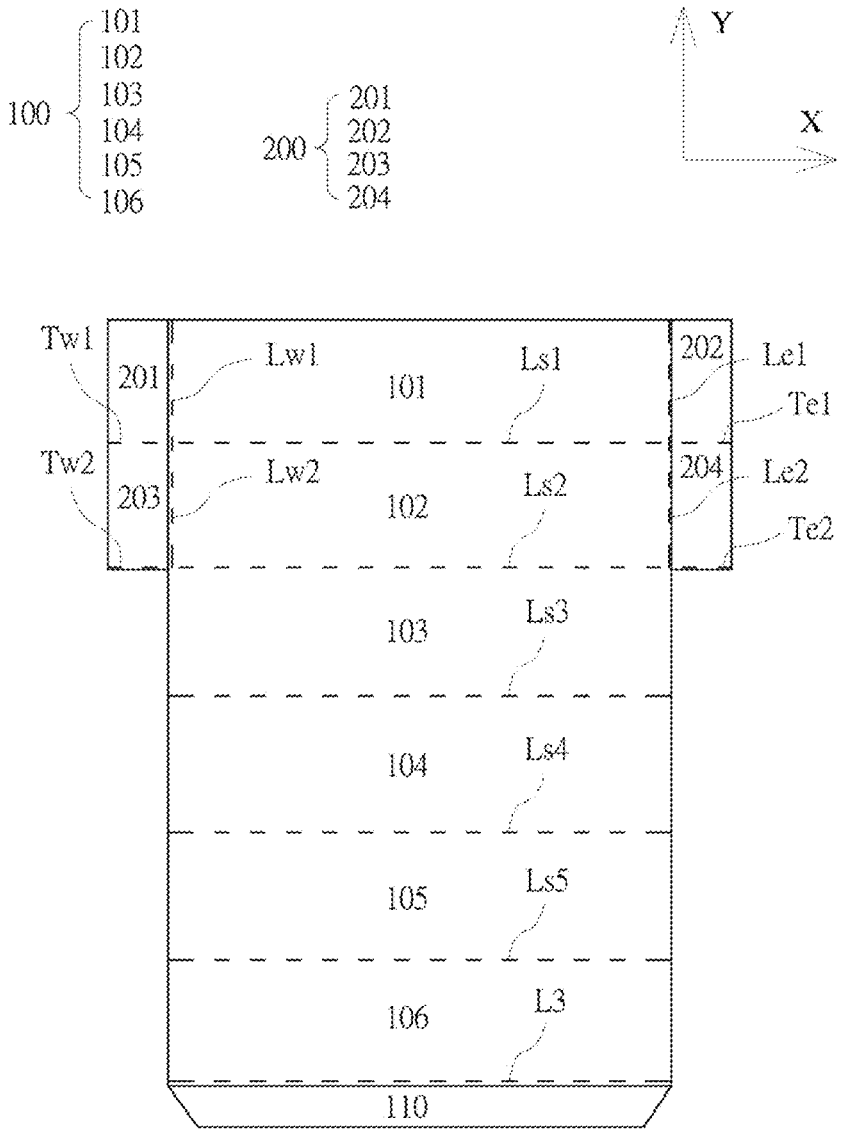
Figure 19:
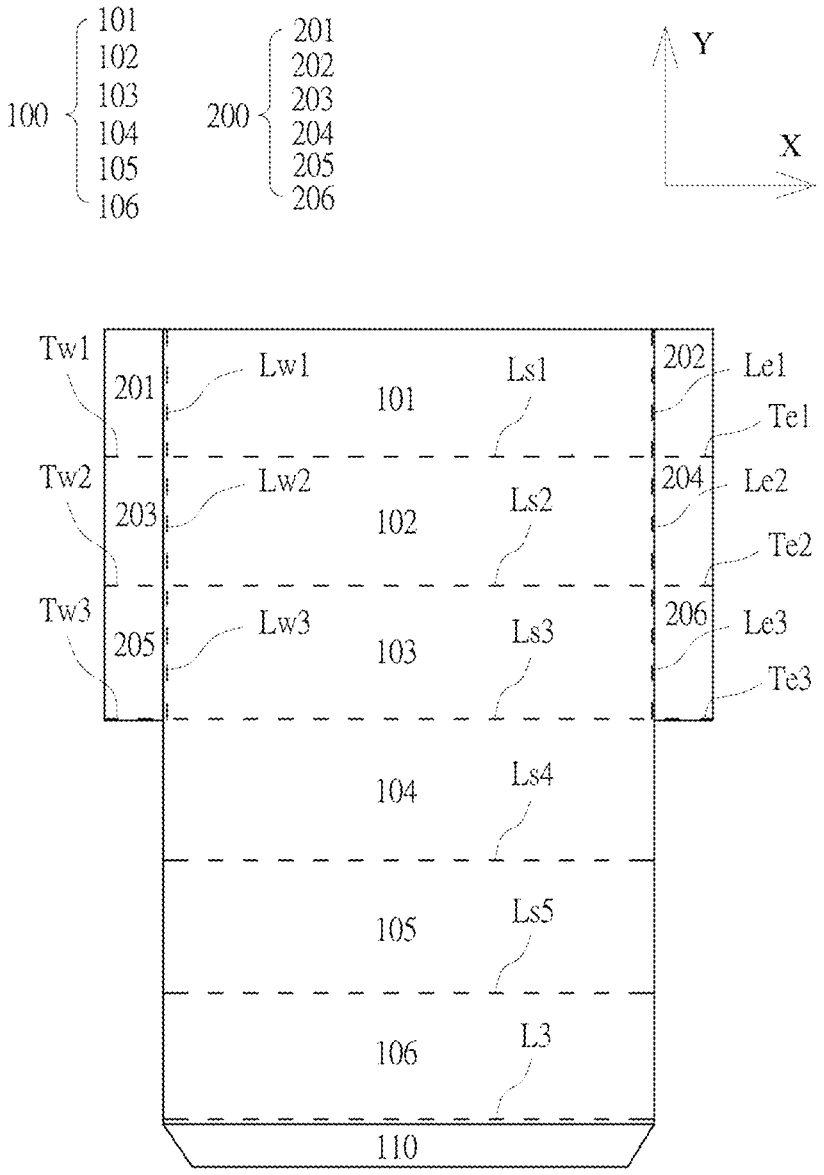
Figure 20:
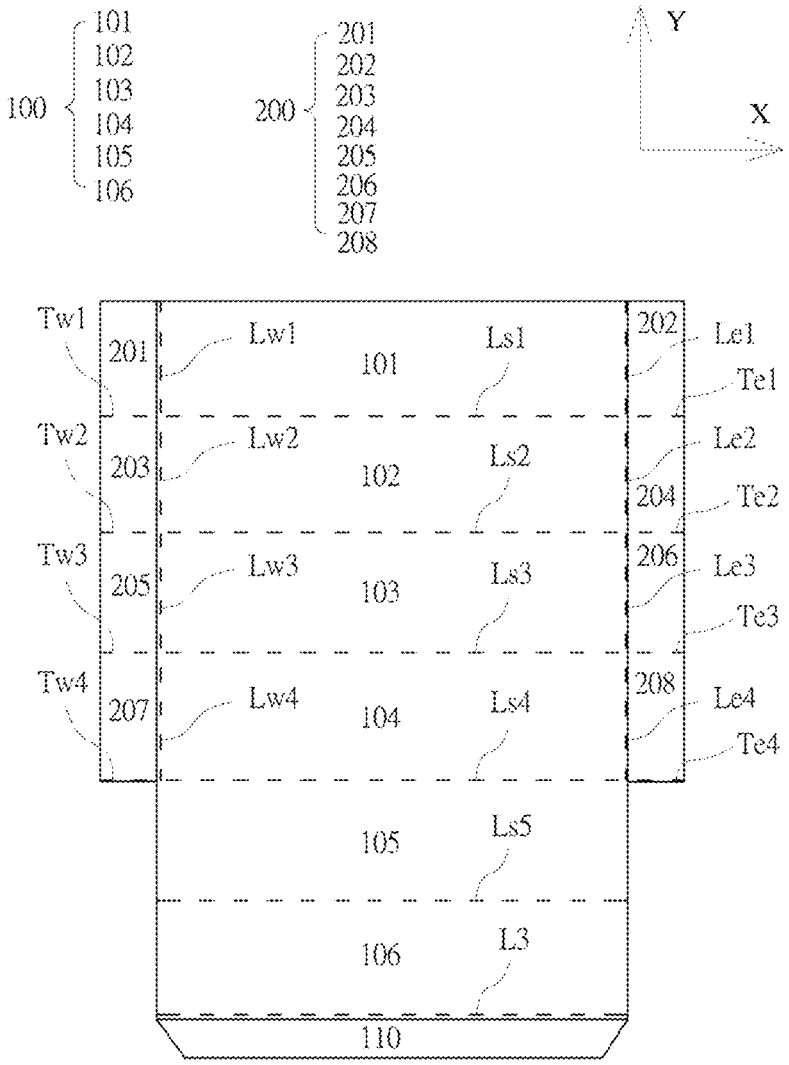
Figure 21:
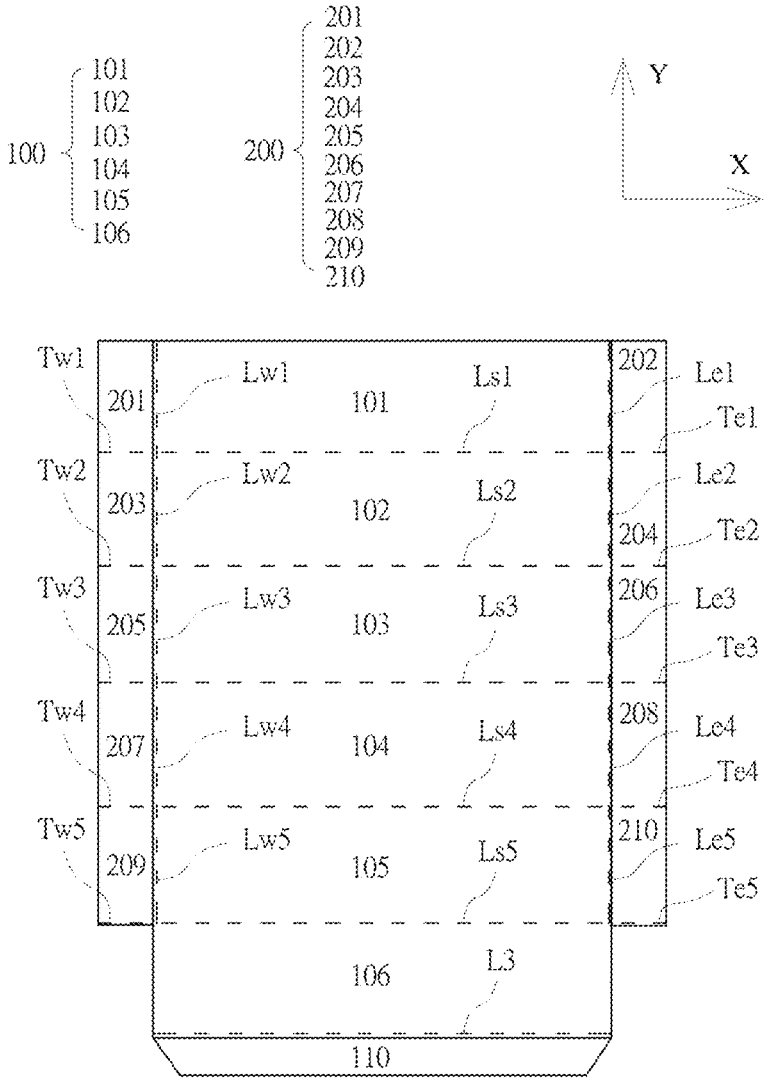
Figure 22:
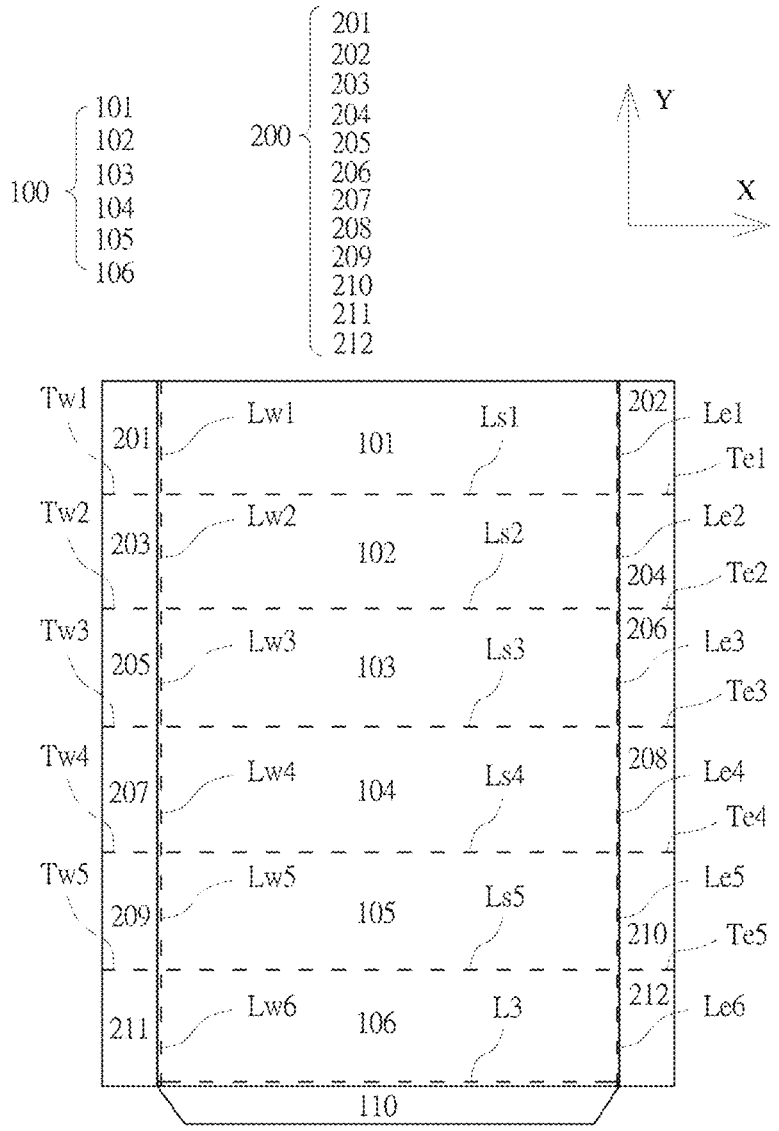

Next, folding is performed respectively along the primary separating fold lines (Ls1, Ls2, Ls3), the left vertical separating fold lines (Lw1, . . . , Lw4), left horizontal separating fold lines (Tw1, . . . , Tw3), the right vertical separating fold lines (Le1, . . . , Le4), the right horizontal separating fold lines (Te1, . . . , Te3), and a secondary fold line (L3), to erect and form the first front presentation region (101), . . . , the fourth front presentation region (104), the first folding region (201), . . . , the eighth folding region (208), and a joint portion (110), so that a self-standing paper product having a four-sided cross section that can stand by itself can be formed. As shown in FIG. 16, pattern forms may be designed according to a requirement of a user in the four front presentation regions of the self-standing paper product or an object such as a photo, a picture or a file is inserted in the folding regions.

Embodiment 6

Referring to FIG. 17 to FIG. 23A and FIG. 23B, 17 to FIG. 23A and FIG. 23B are respectively schematic diagrams showing an unfolded state and an erected state of Embodiment 6 of a self-standing paper product according to the present invention. N=5 and M=2, 4, 6, 8, 10 or 12. The self-standing paper product is a paper card, and an unfolded state of the self-standing paper product includes: a front presentation portion (100) and a folding portion (200). The front presentation portion is separated by five primary separating fold lines (Ls1, . . . , Ls5) into a first front presentation region (101), . . . , and a sixth front presentation region (106). In addition, a joint portion (110) extends on a lower side of the sixth front presentation region (106), and one secondary fold line (L3) is disposed between the joint portion (110) and the sixth front presentation region (106). The length of the secondary fold line (L3) is less than or equal to those of the primary separating fold lines (Ls1, . . . , Ls5). During the step of erection and formation, the joint portion (110) and the first front presentation region (101) may be joined. For example, the joint portion (110) is bonded to a rear surface of the first front presentation region (101).

According to the technical concept of the present invention, a fastening portion and a fastened portion (not shown) may be respectively disposed on an upper side of the first front presentation region (101) and a lower side of the sixth front presentation region (106), so that during the step of erection and formation, two sides of the paper card may be fastened together by using the fastening portion and the fastened portion.

FIG. 17 to FIG. 22 are respectively schematic diagrams showing an unfolded state when a quantity M of folding regions of the self-standing paper product in the present invention is 2, 4, 6, 8, 10 or 12. As the quantity of the folding regions increases, corresponding quantities of left vertical separating fold lines (Lw1, . . . , Lw6), left horizontal separating fold lines (Tw1, . . . , Tw5), right vertical separating fold lines (Le1, . . . , Le6), and right horizontal separating fold lines (Te1, . . . , Te5) are disposed.

For example, when M=12, in a folding portion (200), on left sides of a first front presentation region (101), . . . , and a sixth front presentation region (106), six left vertical separating fold lines (Lw1, . . . , Lw6) and five left horizontal separating fold lines (Tw1, . . . , Tw5) extend to forma first folding region (201), a third folding region (203), . . . , and an eleventh folding region (211). On right sides of the first front presentation region (101), . . . , and the sixth front presentation region (106), six right vertical separating fold lines (Le1, . . . , Le6) and five right horizontal separating fold lines (Te1, . . . , Te5) extend to forma second folding region (202), a fourth folding region (204), . . . , and a twelfth folding region (212). The left vertical separating fold lines (Lw1, . . . , Lw6) and the right vertical separating fold lines (Le1 Le6) respectively have equal lengths to a left lateral side and a right lateral side of a connected front presentation portion. The lengths of the left horizontal separating fold lines (Tw1, . . . , Tw5) and the lengths of the right horizontal separating fold lines (Te1, . . . , Te5) may be equal or not equal to each other.

Figure 23A:
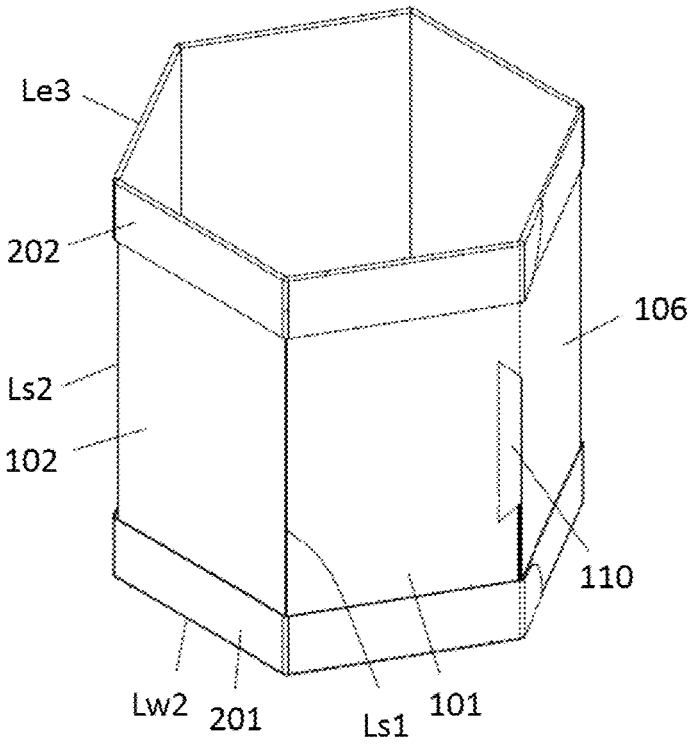
FIG. 23A is a schematic diagram of a folded and erected state in FIG. 22 according to the present invention.

Next, folding is performed respectively along the primary separating fold lines (Ls1, . . . , Ls5), the left vertical separating fold lines (Lw1, . . . , Lw6), the left horizontal separating fold lines (Tw1, . . . , Tw5), the right vertical separating fold lines (Le1, . . . , Le6), the right horizontal separating fold lines (Te1, . . . , Te5), and a secondary fold line (L3), to erect and form the first front presentation region (101), . . . , the sixth front presentation region (106), the first folding region (201), . . . , the twelfth folding region (212), and a joint portion (110), so that a self-standing paper product having a six-sided cross section that can stand by itself can be formed. As shown in FIG. 23A, pattern forms may be designed according to a requirement of a user in the six front presentation regions of the self-standing paper product or an object such as a photo, a picture or a file is inserted in each folding portion.

Figure 23B:
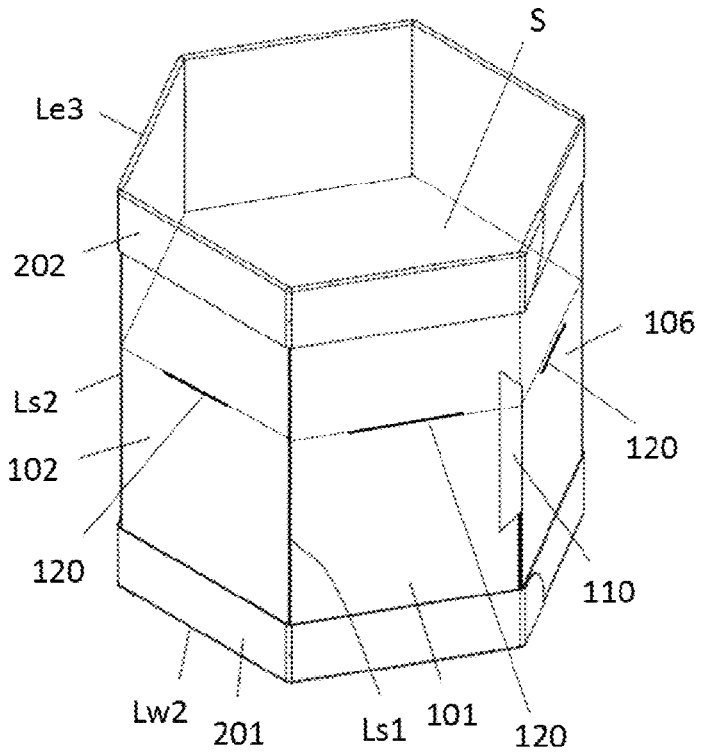
FIG. 23B is a schematic diagram of a folded and erected state of another application in FIG. 22 according to the present invention.

In addition, referring to FIG. 23B, according to the technical concept of the present invention, a plurality of cut lines (120) that are located in a same plane and are not connected to each other may further be carved in a direction perpendicular to the primary separating fold lines in the first front presentation region (101), . . . , and the sixth front presentation region (106), so that during the step of erection and formation, a placement member (S) having a regular hexagonal structure may be inserted in a hollow inside of the self-standing paper product through the cut lines, so as to form a storage structure having a plurality of layers, so that an object is placed through the placement member (S). A plurality of placement members (S) may be used to store a plurality of objects according to a quantity of layers.

Figure 24:
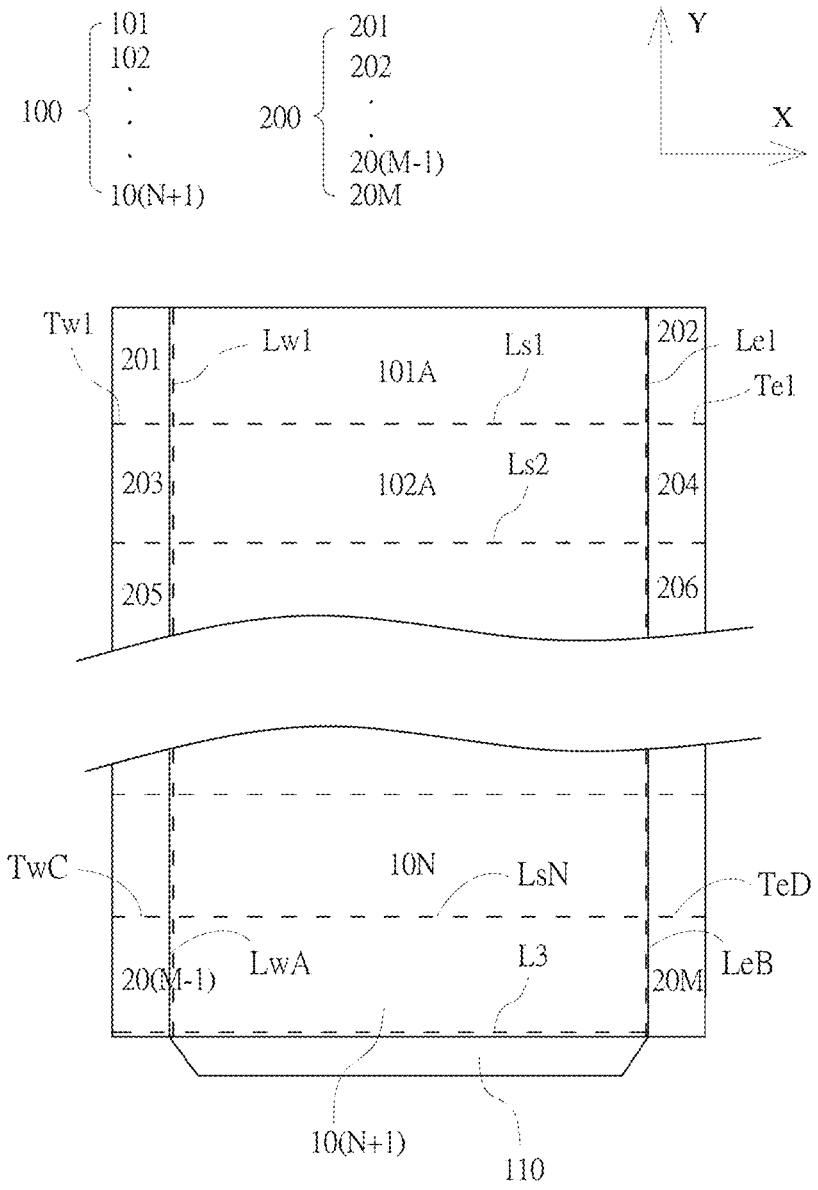
FIG. 24 is a standard schematic diagram of an unfolded state of a self-standing paper product according to the present invention.

As discussed above, although the technical content of the present invention has been described in detail by using the foregoing embodiments, the present invention is not limited to these implementations only. Referring to FIG. 24, FIG. 24 is a standard schematic diagram showing an unfolded state of a self-standing paper product according to the present invention. According to the manufacturing method in the present invention, a user may set corresponding quantities of primary separating fold lines (Ls1, . . . , LsN), left vertical separating fold lines (Lw1, . . . , LwA), left horizontal separating fold lines (Tw1, . . . , TwC), right vertical separating fold lines (Le1, . . . , LeB), right horizontal separating fold lines (Te1, . . . , TeD) or a secondary fold line (L3) according to an actual requirement, to form (N+1) front presentation regions, M folding regions or a joint portion (110) for subsequent printing of patterns and erection and formation. A, B, C, D, N, and M are all natural numbers, and A and B are preferably respectively between 1 and 26. C, D, and N are preferably respectively between 1 and 25. M is preferably between 1 and 52.

Generally, the self-standing paper product in the present invention is used as a storage structure to replace a photo storage book, a calendar, a bellyband, a photo frame, a desktop catalog in the prior art, so that many disadvantages in the prior art are overcome, and many advantages are further provided. The characteristics of the present invention may be presented. Different applications are provided according to different requirements. Manufacturing costs are relatively low in massive manufacturing.

As discussed above, although the content of the present invention has been described in detail by using the foregoing embodiments, the present invention is not limited to these implementations only.

A person of ordinary skill in the art of the present invention should know and understand that various variations and modifications may further be made without departing from the spirit and scope of the present invention. For example, the technical content shown in the foregoing embodiments is combined or varied to obtain new implementations. The implementations should certainly al so be considered as content that falls within the present invention. Therefore, the scope that the disclosure seeks to protect covers the appended claims and the scope defined by the claims.

REFERENCE NUMERALS

| | |
|---|---|
| S1 | Step of forming a primary separating fold line |
| S2 | Step of forming a left vertical separating fold line, a right vertical separating fold line, a left horizontal separating fold line and/or a right horizontal separating fold line |
| S3 | Step of erection and formation |
| 100 | Front presentation portion |
| 101 | First front presentation region |
| 102 | Second front presentation region |
| 103 | Third front presentation region |
| 104 | Fourth front presentation region |
| 105 | Fifth front presentation region |
| 106 | Sixth front presentation region |
| 10N | Nth front presentation region |
| 110 | Joint portion |
| 120 | Cut line |
| 200 | Folding portion |
| 201 | First folding region |
| 202 | Second folding region |
| 203 | Third folding region |
| 204 | Fourth folding region |
| 205 | Fifth folding region |
| 206 | Sixth folding region |
| 207 | Seventh folding region |
| 208 | Eighth folding region |
| 209 | Ninth folding region |
| 210 | Tenth folding region |

-continued

| | |
|---|---|
| 211 | Eleventh folding region |
| 212 | Twelfth folding region |
| 20(M−1) | (M−1)th folding region |
| 20M | $M^{th}$ folding region |
| 300 | Binder hole |
| Ls1, . . . , LsN | Primary separating fold line |
| Lw1, . . . , LwA | Left vertical separating fold line |
| Le1, . . . , LeB | Right vertical separating fold line |
| Tw1, . . . , TwC | Left horizontal separating fold line |
| Te1, . . . , TeD | Right horizontal separating fold line |
| L3 | Secondary fold line |
| P | Photo, picture |
| PA | Loose leaf binder |
| X | Supporting member |
| S | Bearing member |

What is claimed is:

1. A method for manufacturing a self-standing paper product, wherein the manufacturing method at least comprises:

a step of forming a primary separating fold line, wherein N primary separating fold lines parallel to an X axis direction are formed on a single paper card, so as to form a front presentation portion separated into (N+1) front presentation regions, wherein N is natural number, and N is between 1 and 25;

a step of forming a left vertical separating fold line, a right vertical separating fold line, a left horizontal separating fold line and a right horizontal separating fold line, wherein A left vertical separating fold lines and B right vertical separating fold lines parallel to a Y axis direction are respectively formed on a left side and/or a right side of at least one of the front presentation regions, and C left horizontal separating fold lines and D right horizontal separating fold lines respectively extending on a left side and/or a right side of each primary separating fold line are formed, so as to form a folding portion separated into M folding regions, wherein A, B, C, D, and M are all natural numbers, A and B are respectively between 1 and 26, C and D are respectively between 1 and 25, and M is between 1 and 52; and a step of erection and formation, wherein folding is performed respectively along the primary separating fold lines, the left vertical separating fold lines, the left horizontal separating fold lines, the right vertical separating fold lines, and the right horizontal separating fold lines to erect and form the (N+1) front presentation regions and the M folding regions, so as to form a self-standing paper product that at least comprises the front presentation portion and the folding portion; each of the front presentation regions is disposed at outer surface of the self-standing paper product, and each of the folding regions is formed in the manner of being folded toward outside of the self-standing paper product; the front presentation region and the folding region are configured to have an interspace therebetween; wherein the surface of at least one of the (N+1) front presentation regions, or at least one of the M folding regions does not have any graph and text and has a blank, a white background, a black background or an original paper color or is printed with a pattern or a text designated according to a requirement of a user.

2. The method for manufacturing a self-standing paper product according to claim 1, after the step of forming a primary separating fold line, further comprising a step of forming a secondary fold line, wherein the secondary fold line parallel to the primary separating fold lines is formed above the first front presentation region or below the $(N+1)^{th}$ front presentation region, so that a joint portion is obtained through separation on an upper side or a lower side of the paper card.

3. The method for manufacturing a self-standing paper product according to claim 2, wherein the step of erection and formation further comprises joining the first front presentation region and the $(N+1)^{th}$ front presentation region by using the joint portion.

4. A self-standing paper product, which is a column structure whose cross section is an (N+1)-sided shape and formed of a paper card; wherein the unfolded state of the self-standing paper product comprising:

a front presentation portion, located in the front of the paper card, wherein N primary separating fold lines parallel to an X axis direction are disposed in the front presentation portion to sequentially obtain (N+1) front presentation regions through separation, wherein N is natural number, and N is more than or equal to 2, and is less than or equal to 25;

a folding portion, located on a left side and/or a right side of the front presentation portion, wherein A left vertical separating fold lines and/or B right vertical separating fold lines parallel to a Y axis direction are disposed between the folding portion and the front presentation portion, and C left horizontal separating fold lines and/or D right horizontal separating fold lines extending from each primary separating fold line towards a left side and a right side are respectively disposed between folding regions, so as to extend outwards from the left side and/or the right side of the front presentation portion to form M folding regions, wherein A, B, C, D, and M are all natural numbers, A and B are respectively between 1 and 26, C and D are respectively between 1 and 25, and M is between 1 and 52, wherein each of the front presentation regions is disposed at outer surface of the self-standing paper product, and each of the folding regions is formed in the manner of being folded toward outside of the self-standing paper product; the front presentation region and the folding region are configured to have an interspace therebetween;

the (N+1) front presentation regions respectively have (N+1) front presentation areas; and the M folding regions respectively have M folding areas, and each of the M folding areas is respectively less than the adjacent front presentation area.

5. The self-standing paper product according to claim 4, wherein N=2, M=6, in the folding portion, on left sides of the first front presentation region, the second front presentation region, and the third front presentation region, three left vertical separating fold lines and two left horizontal separating fold lines are respectively connected to the first folding region, the third folding region, and the fifth folding region, on right sides of the first front presentation region, the second front presentation region, and the third front presentation region, three right vertical separating fold lines and two right horizontal separating fold lines extend to form the second folding region, the fourth folding region, and the sixth folding region, the left vertical separating fold lines and the right vertical separating fold lines respectively have equal lengths to a left lateral side and a right lateral side of the connected front presentation portion, a joint portion extends on an upper side of the first front presentation region or a lower side of the third front presentation region, a secondary fold line is disposed between the joint portion and the first front presentation region and/or the third front presentation region, and the length of the secondary fold line is less than or equal to that of the primary separating fold lines.

6. The self-standing paper product according to claim 4, wherein N=5, M=12, in the folding portion, from the first front presentation region to the sixth front presentation region, six left vertical separating fold lines and five left horizontal separating fold lines extend to form the first folding region, the third folding region, the fifth folding region, the seventh folding region, the ninth folding region, and the eleventh folding region, and six right vertical separating fold lines and five right horizontal separating fold lines extend to form the second folding region, the fourth folding region, the sixth folding region, the eighth folding region, the tenth folding region, and the twelfth folding region, the left vertical separating fold lines and the right vertical separating fold lines respectively have equal lengths of a left lateral side and a right lateral side of the connected front presentation portion, a joint portion extends on an upper side of the first front presentation region or a lower side of the sixth front presentation region, a secondary fold line is disposed between the joint portion and the first front presentation region or the sixth front presentation region, and the length of the secondary fold line is less than or equal to that of the primary separating fold line.

* * * * *